US012729469B2

(12) United States Patent
Christman, Jr. et al.

(10) Patent No.: US 12,729,469 B2
(45) Date of Patent: Sep. 8, 2026

(54) TUFTING MACHINE YARN FEED SYSTEM

(71) Applicant: Card-Monroe Corp., Chattanooga, TN (US)

(72) Inventors: William M. Christman, Jr., Chattanooga, TN (US); Ricky E. Mathews, Sale Creek, TN (US)

(73) Assignee: Card-Monroe, Corp., Chattanooga, TN (US)

( * ) Notice: Subject to any disclaimer, the term of this patent is extended or adjusted under 35 U.S.C. 154(b) by 220 days.

(21) Appl. No.: 18/541,407

(22) Filed: Dec. 15, 2023

(65) Prior Publication Data

US 2024/0200252 A1 Jun. 20, 2024

Related U.S. Application Data

(60) Provisional application No. 63/432,717, filed on Dec. 15, 2022.

(51) Int. Cl.
*D05C 15/10* (2006.01)
*D05C 15/14* (2006.01)

(52) U.S. Cl.
CPC ..... *D05C 15/14* (2013.01); *D05C 15/10* (2013.01)

(58) Field of Classification Search
CPC ..... D05C 15/10; D05C 15/14; D05C 15/16; D05C 15/18; D05C 15/26
See application file for complete search history.

(56) References Cited

U.S. PATENT DOCUMENTS

| | | | |
|---|---|---|---|
| 2,842,259 | A | 7/1958 | Hoeselbarth |
| 2,862,465 | A | 12/1958 | Card |
| 2,866,424 | A | 12/1958 | Masland, II |
| 2,884,881 | A | 5/1959 | Oberholtzer |
| 2,932,181 | A | 4/1960 | MacCaffray, Jr. |
| 2,966,866 | A | 1/1961 | Card |

(Continued)

FOREIGN PATENT DOCUMENTS

| | | |
|---|---|---|
| EP | 0456864 A1 | 11/1991 |
| GB | 1363974 | 7/1972 |

(Continued)

OTHER PUBLICATIONS

Extended European Search Report for related Application No. 15803555.0-1018 / 3152351 // Patent No. PCT/US2015/034549, dated Jan. 22, 2018.

(Continued)

*Primary Examiner* — Nathan E Durham
(74) *Attorney, Agent, or Firm* — Adams & Reese LLP; D. Scott Sudderth

(57) ABSTRACT

A yarn feed system configured to control feeding of individual yarns to the needles of a tufting machine, and which system can be manufactured as a substantially standardized unit or attachment that can be removably mounted to a tufting machine. The yarn feed unit includes a series of yarn feed devices each of which can include a motor package having two or more yarn feed motors coupled together with a shared or integrated motor controller configured for controlling each motor of the motor package independently. The yarn feed devices can feed one or more selected yarns to associated ones of the needles of the tufting machine according to pattern instructions for a pattern being tufted.

23 Claims, 8 Drawing Sheets

(56) References Cited

U.S. PATENT DOCUMENTS

| | | | |
|---|---|---|---|
| 3,067,701 | A | 12/1962 | Wilcox |
| 3,075,482 | A | 1/1963 | Card |
| 3,095,840 | A | 7/1963 | Ballard |
| 3,095,841 | A | 7/1963 | Ballard et al. |
| 3,103,903 | A | 9/1963 | Broadrick et al. |
| 3,112,721 | A | 12/1963 | Oberholtzer et al. |
| 3,221,683 | A | 12/1965 | Abelsma |
| 3,605,660 | A | 9/1971 | Short |
| 3,752,094 | A | 8/1973 | Short |
| 3,847,098 | A | 11/1974 | Hammel, Jr. |
| 3,895,355 | A | 7/1975 | Shorrock |
| 3,906,876 | A | 9/1975 | Fittoa |
| 3,943,865 | A | 3/1976 | Short et al. |
| 4,077,164 | A | 3/1978 | Peterman, Jr. |
| 4,127,078 | A | 11/1978 | Spanel et al. |
| 4,193,358 | A | 3/1980 | Woodcock |
| 4,221,317 | A | 9/1980 | Fukada et al. |
| 4,244,309 | A | 1/1981 | Spanel et al. |
| 4,245,794 | A | 1/1981 | Hasegawa et al. |
| 4,267,787 | A | 5/1981 | Fukada |
| 4,285,285 | A | 8/1981 | Chambers et al. |
| 4,317,419 | A | 3/1982 | Spanel et al. |
| 4,366,761 | A | 1/1983 | Card |
| 4,393,793 | A | 7/1983 | Beasley |
| 4,469,037 | A | 9/1984 | Bost, Jr. |
| 4,519,332 | A | 5/1985 | Fukada |
| 4,549,496 | A | 10/1985 | Kile |
| 4,608,935 | A | 9/1986 | Bardsley |
| 4,619,212 | A | 10/1986 | Card et al. |
| 4,688,497 | A | 8/1987 | Card et al. |
| 4,829,917 | A | 5/1989 | Morgante et al. |
| 4,856,104 | A | 8/1989 | Stoll et al. |
| 4,856,441 | A | 8/1989 | Kurata |
| 4,864,946 | A | 9/1989 | Watkins |
| 4,867,080 | A | 9/1989 | Taylor et al. |
| 4,870,915 | A | 10/1989 | Bagnall |
| 4,981,091 | A | 1/1991 | Taylor et al. |
| 5,005,498 | A | 4/1991 | Taylor et al. |
| 5,058,518 | A | 10/1991 | Card et al. |
| 5,080,028 | A | 1/1992 | Ingram |
| 5,094,178 | A | 3/1992 | Watkins |
| 5,182,997 | A | 2/1993 | Bardsley |
| 5,205,233 | A | 4/1993 | Ingram |
| 5,285,821 | A | 2/1994 | Fredriksson |
| 5,288,556 | A | 2/1994 | Lemelson |
| 5,353,582 | A | 10/1994 | Citterio et al. |
| 5,383,415 | A | 1/1995 | Padgett, III |
| 5,458,075 | A | 10/1995 | Tice et al. |
| 5,461,996 | A | 10/1995 | Kaju |
| 5,526,760 | A | 6/1996 | Ok |
| 5,544,064 | A | 8/1996 | Beckwith |
| 5,544,605 | A | 8/1996 | Frost |
| 5,549,064 | A | 8/1996 | Padgett, III |
| 5,575,228 | A | 11/1996 | Padgett, III et al. |
| 5,588,383 | A | 12/1996 | Davis et al. |
| 5,622,126 | A | 4/1997 | Card et al. |
| 5,662,054 | A | 9/1997 | Bardsley |
| 5,738,030 | A | 4/1998 | Ok |
| 5,743,200 | A | 4/1998 | Miller et al. |
| 5,743,201 | A | 4/1998 | Card et al. |
| 5,806,446 | A | 9/1998 | Morrison et al. |
| 5,983,815 | A | 11/1999 | Card |
| 6,009,818 | A | 1/2000 | Card et al. |
| 6,202,580 | B1 | 3/2001 | Samilo |
| 6,213,036 | B1 | 4/2001 | Slattery |
| 6,244,203 | B1 | 6/2001 | Morgante et al. |
| 6,283,053 | B1 | 9/2001 | Morgante et al. |
| 6,439,141 | B2 | 8/2002 | Morgante et al. |
| 6,508,185 | B1 | 1/2003 | Morgante et al. |
| 6,516,734 | B1 | 2/2003 | Morgante et al. |
| 6,550,407 | B1 | 4/2003 | Frost et al. |
| 6,651,572 | B2 | 11/2003 | Bennett et al. |
| 6,725,789 | B1 | 4/2004 | Hall |
| 6,807,917 | B1 | 10/2004 | Christman et al. |
| 6,834,601 | B2 | 12/2004 | Card et al. |
| 6,877,447 | B2 | 4/2005 | Frost et al. |
| 6,877,449 | B2 | 4/2005 | Morgante et al. |
| 6,945,183 | B2 | 9/2005 | Card et al. |
| 6,945,184 | B2 | 9/2005 | Frost et al. |
| 7,073,695 | B1 | 7/2006 | Haselwander |
| 7,089,874 | B2 | 8/2006 | Morgante et al. |
| 7,096,806 | B2 | 8/2006 | Card et al. |
| 7,685,952 | B2 | 3/2010 | Frost et al. |
| 7,905,187 | B2 | 3/2011 | Card et al. |
| 8,201,509 | B2 | 6/2012 | Christman, Jr. |
| 8,443,743 | B2 | 5/2013 | Christman, Jr. |
| 9,202,733 | B2 * | 12/2015 | Hosek ..... B25J 9/043 |
| 9,663,885 | B2 | 5/2017 | Frost et al. |
| 10,072,368 | B2 | 9/2018 | Mathews |
| 10,167,785 | B2 | 1/2019 | Frost et al. |
| 10,704,170 | B2 | 7/2020 | Debuf et al. |
| 10,865,506 | B2 | 12/2020 | Mathews |
| 2002/0037388 | A1 | 3/2002 | Morgante et al. |
| 2004/0025767 | A1 | 2/2004 | Card et al. |
| 2005/0056197 | A1 | 3/2005 | Card et al. |
| 2005/0204975 | A1 | 9/2005 | Card et al. |
| 2011/0048305 | A1 | 3/2011 | Christman, Jr. |
| 2012/0325134 | A1 | 12/2012 | Beatty et al. |
| 2013/0180440 | A1 | 7/2013 | Hall |
| 2018/0363186 | A1 | 12/2018 | Mathews |
| 2024/0052539 | A1 | 2/2024 | Beatty |

FOREIGN PATENT DOCUMENTS

| | | | |
|---|---|---|---|
| GB | 2002040 | | 7/1978 |
| GB | 2002828 | | 7/1978 |
| GB | 2186297 | | 1/1987 |
| JP | 06-207373 | A | 7/1994 |
| JP | 2003/089963 | A | 3/2003 |
| WO | WO2001/059195 | A2 | 8/2001 |
| WO | WO2004/057084 | A2 | 7/2004 |
| WO | WO2011/031488 | A1 | 3/2011 |

OTHER PUBLICATIONS

Supplementary Partial European Search Report for related Application No. 15803555.0-1710 / 3152351 // Patent No. PCT/US2015/034549, mailed Oct. 17, 2017.

Notification, International Search Report and Written Opinion of the International Search Authority regarding related PCT/US2023/084351 dated Apr. 24, 2024.

* cited by examiner

TUFTING MACHINE YARN FEED SYSTEM

CROSS-REFERENCE

The present Patent Applications claims the benefit of U.S. Provisional Patent Application No. 63/432,717, filed Dec. 15, 2022.

INCORPORATED BY REFERENCE

The disclosure and figures made in U.S. Provisional Patent Application No. 63/432,717, filed on Dec. 15, 2022, is specifically incorporated by reference herein as if set forth in its entirety.

TECHNICAL FIELD

The present disclosure generally relates to carpet tufting machines and in particular to yarn feed systems and/or pattern attachments including a series of yarn feed devices and drive mechanisms therefor for controlling the feeding of yarns to the needles of a tufting machine.

BACKGROUND

In the carpet-tufting field, considerable emphasis has been placed on developing new, eye-catching carpet patterns, including patterns with multiple colors and more intricate designs to keep up with changing consumer tastes and increased competition in the marketplace. With the development of tufting machines or systems such as "ColorPoint" by Card-Monroe Corp., designers have been enabled greater freedom to design and develop more complex tufted pattern designs to meet increasing customer demands. Such increasingly complex patterned tufted carpets include multi-colored tufted patterns, and tufted patterns with different pile heights, combinations of cut and loop pile tufts and other sculptured effects, which can be formed by controlling feeding of the yarns to the needles. Single-end and double-end yarn feed attachments have been developed to control of the feeding of the yarns through the use of an increased number of feed rolls and drive motors for feeding single yarns to each of the needles of a tufting machine. However, as the number of yarn feed rolls and the number of motors for driving such yarn feed rolls is increased, there is a corresponding increase in the costs and complexity of such yarn feed attachments. In addition, increasing the number of motors and yarn feed rolls also increases the size or footprint of the yarn feed attachments, which further increases the complexity of manufacturing and installation of such yarn feed attachments as a part of a tufting machine when the tufting machine is installed in the field.

Accordingly, it can be seen that needs exist for tufting machines and yarn feed systems that address these and other related and unrelated problems in the art.

SUMMARY

Briefly described, the present disclosure generally relates to tufting machines and systems for production of tufted articles, including, without limitation, carpets, rugs, artificial grass or turf, and other tufted products; and to yarn feed systems, including, in embodiments, pattern yarn feed attachments that can be removably mounted on a tufting machine, which are adapted to feed a series of yarns to each of the needles of the tufting machine. The feeding of the yarns to each needle can be independently controlled by the yarn feed system to provide enhanced precision and control of the feeding of the yarns as needed or desired to form tufts of yarns (e.g., loop pile tufts, cut pile tufts, or combinations thereof) in a backing material being passed through the tufting machine, in accordance with tufted pattern instructions or designs.

In embodiments, each yarn feed unit can include a frame defining a housing in which a series of yarn feed devices are received and supported. Each of the yarn feed devices generally can include a yarn feed roll assembly mounted in an operative or driven relationship with an associated motor configured to drive rotation of one or more yarn feed rolls of the yarn feed device. In some embodiments, the yarn feed devices can be arranged in sets or groups that can be removably mounted within frames, thus defining modules that can be removably received within the housing of a yarn feed unit. In embodiments, such modules can include two or more yarn feed devices mounted with a common frame or housing, or otherwise packaged together, and which can include a plurality of yarn feed roll assemblies and motors.

In embodiments, each of the yarn feed devices will include one or more yarn feed roll assemblies, each of which can include a housing or roll support structure received and/or releasably mounted over a forward or operative end of a drive shaft of an associated motor, with the drive shaft of motor extending therethrough. One or more series or sets of yarn feed rolls, for example, in one embodiment, two sets of 2-3 yarn feed rolls, can be located along a front facing portion of the housing or roll support structure. In one embodiment, the forward body portions of the yarn feed rolls of each set of yarn feed rolls can be located in a spaced-apart arrangement, substantially out of contact with each other; and with at least one of the yarn feed rolls being engaged and driven by the drive shaft of the associated motor.

In embodiments, the yarn feed rolls can be formed as substantially unitary or one-piece structures, or, in some embodiments, can include a series of components combined into an assembly. For example, in embodiments, each of the yarn feed rolls can comprise injection molded or extruded rollers formed of a lightweight, high strength plastic, composite or synthetic material, with each yarn feed roll including a body having a first, proximal or drive end and a second, distal or feed end. A gear such as a spur, helical, spiral or other type of gear or sprocket having a series of radially projecting teeth also can be located or formed at or about the body of each yarn feed roll adjacent the drive ends thereof, or can be formed separately and mounted to each yarn feed roll. In addition, in embodiments, the bodies of the yarn feed rolls can include textured roll surfaces configured to provide increased traction or grip for pulling the yarns therebetween.

According to one aspect, the housing or roll support structure for each yarn feed roll assembly can comprise one or more sections or portions. For example, in an embodiment, the housing or roll support structure can include one or more plates; including, in embodiments, a base plate configured to mount to the housing of the yarn feed unit, and which further can be configured along a rear or drive side thereof to receive and releasably engage its corresponding motor, e.g., being mounted thereto such as by releasable fasteners. In addition, a cover plate can be mounted to the front side of the base plate, and can include recesses or openings defined in a front facing surface thereof. In embodiments, the yarn feed rolls of one or more yarn feed roll assemblies generally can be removably received within the recesses or openings formed in the front facing surface of the cover plate; for example, being arranged in a staggered or offset arrangement with their gear teeth engaging and intermeshing with each other, and with the forward portions thereof spaced apart so as to provide multiple points and/or a substantially increased area of contact between the yarns and the roll surfaces, and without the yarns being engaged and pinched therebetween. In embodiments, the yarn feed roll assemblies, including the sets of yarn feed rolls thereof can be removed with the housings or roll support structures as a unit, without necessarily having to remove the entire yarn feed device from the yarn feed unit or attachment. Alternatively, the yarn feed rolls could also be removed individually.

According to other aspects, each of the yarn feed roll assemblies can include two or more sets of yarn feed rolls, and at least one yarn feed roll of each set of yarn feed rolls can be linked to the drive shaft of its associated motor so as to be driven or rotated by the associated motor. In embodiments, each yarn feed roll assembly can be coupled or connected to a pair of associated motors coupled together with a shared motor controller. In embodiments, the motors can be arranged in a motor package or module. For example, in some embodiments, a motor package including two or more motors and a shared or integrated motor controller configured and operable to control each motor independently of the other motor, can be coupled to the yarn feed roll assemblies of each yarn feed device, with each motor being independently controlled by the shared motor controller to drive rotation of the set of yarn feed rolls connected thereto at different rates as needed to feed the yarns to the needles of the tufting machine.

In embodiments, such a motor package can be configured with a reduced footprint and can enable a reduction the number of electrical connections. In some embodiments, the motor packages further can enable a potential reduction in overall size and weight of the motors for driving the yarn feed roll, and thus can potentially enable a reduction in size and weight of the yarn feed devices; and in embodiments, further can help reduce the size, footprint and overall weight of the yarn feed unit.

In addition, in some embodiments, one or more status indicators can be provided, and can be configured to provide a visual or other indication of an operational status of the motors. For example, in embodiments, one or more indicators, such as LED's or other lights, can be located along the housing or roll support structure and can be linked to the motor controller. In some embodiments, the lights can be arranged behind or can be located along the cover plate of each housing or roll support structure. In some embodiments, the cover plate can be formed from an at least partially translucent material so that the lights can be seen therethrough when illuminated. The lights can flash or be illuminated to provide an indication of motor status, e.g., showing different colors to indicate different operating conditions and/or to indicate an error or fault condition.

During operation, in embodiments, the motor of each yarn feed device will drive at least one of the yarn feed rolls, with the remaining yarn feed rolls being driven by the engagement with the at least one driven yarn feed roll. As the yarn feed rolls are rotated, the yarns fed therebetween will be engaged and directed to selected needles of the tufting machine for formation of tufts of yarns within the backing material passing through the tufting machine. The configuration and structure of the present yarn feed roll assembly is configured to enable controlled feeding of the yarns thereby, as well as the efficient removal and replacement of the yarn feed rolls of each of the yarn feed devices individually and/or as a unit with the removal of the housing or roll support structure, without necessarily requiring removal of the entire yarn feed device. In addition, in embodiments, the motor packages can be removed and/or substituted either for removal/substitution of an entire yarn feed device, or to replace the motors. In embodiments, the sizing and spacing of the yarn feed rolls of the yarn feed drive system also can be varied for feeding different sizes, numbers or types of yarns, or as needed for other applications.

In embodiments, a series of yarn feed tubes also can be connected to the yarn feed devices. The yarn feed tubes can be configured to feed individual yarns from a yarn supply to each of the yarn feed devices, with the yarns being engaged and guided between the drive and idler rolls of their associated yarn feed devices.

According to another aspect, a control system is provided, and can include a system controller having one or more processors configured to execute instructions for forming various tufted patterns. The system controller can communicate with the motor controllers of each motor package of each of the yarn feed devices to provide pattern/operating instructions thereto. In embodiments, each of the motor controllers generally can be directly integrated with the motors of its motor package (e.g., with the motors of the motor package sharing and being independently controlled by an associated motor controller), and will be configured to control their motors in accordance with control instructions received from the system controller, such as being provided with instructions for controlling the feeding of one or more yarns fed by the yarn feed rolls linked thereto from the system control to form a tufted pattern. In addition, in some embodiments, each of the motor controllers can be directly linked to system controller by a communications network cable over which they can receive pattern control instructions from and provide direct feedback to the system controller regarding the current operation of the motors, and, in embodiments, feedback regarding the feeding of the yarns. In some embodiments, a wireless connection also can be provided.

In embodiments, the system controller can monitor feedback from the motor controllers, and provide pattern control instructions to the motor controllers for controlling the speed of each of their associated motors to individually control the feeding of one or more yarns to corresponding selected needles, e.g., by driving the rotation of the yarn feed rolls connected to the motors to feed varying amounts or lengths of yarns to form high or low tufts or yarns in the backing, or to selectively pull back certain yarns, as needed to form the desired or programmed pattern. In some embodiments, the system controller can be provided as a separate control cabinet or workstation having an input mechanism, such as a keyboard, mouse, etc. and a monitor and which generally will be in communication with a tufting machine control that monitors various operative elements of the tufting machine. Alternatively, in embodiments, the controller and/or at least some its functions can be incorporated or provided by a remote server, or further could be included as part of the system controller which can be mounted to the tufting machine frame, or provided as in control cabinet or station incorporated with the tufting machine.

In addition, in embodiments, the control system can be connected to a design center on which an operator can design a desired carpet patterns and which generally includes a computer that will calculate the parameters of such a design, including parameters including yarn feed rates, pile heights, stitch length, etc. This information can be created as a pattern data file, designed or programmed using pattern design software or a design system and input or electronically communicated to the control system controller and/or the system controller thereof via a network connection, disk or other file transfer. Alternatively, the control system can be provided with the design center components or functionality programmed therein so as to enable the operator to design or program carpet patterns at the tufting machine.

According to some aspects, a tufting machine is provided, comprising: at least one needle bar having a plurality of needles configured to carry a plurality of needles mounted therealong; a yarn feed system including a plurality of yarn feed devices configured to feed the plurality of yarns to the needles, each yarn feed device comprising at least one motor package, comprising at least two motors coupled together in a side-by-side or stacked configuration and a shared motor controller directly connected to each motor so as to form a substantially unitary component; and a plurality of yarn feed rolls coupled to each motor of the at least one motor package, each set of yarn feed rolls including at least two yarn feed rolls configured to feed one or more yarns to selected needles; and a control system including programming configured to control feeding of a backing and feeding of each of the plurality of yarns to the needles to form with a selected pattern; wherein the motor controller of each motor package is configured to receive instructions from the control system and independently control each motor of its motor package so as to drive rotation of the yarn feed rolls to selectively feed each yarn to the needles as needed to form high or low tufts of yarns in a backing material, or to pull certain yarns back, as needed to form the selected pattern.

In embodiments of the tufting machine, each set of yarn feed rolls can comprise three yarn feed rolls.

In embodiments of the tufting machine, each yarn feed device further comprises a housing or roll support structure positioned in front of the at least one motor package and configured to receive a drive shaft of each motors of the at least one motor package therethrough; and wherein each of the sets of yarn feed rolls are removably received within the roll support structure.

In embodiments of the tufting machine, the roll support structure can comprise a base plate positioned in front of the motors of the at least one motor package and having at least two openings configured to receive the drive shafts of each motor therethrough; a cover plate received over the base plate and the drive shaft of each motor; and at least one indicator located along the cover plate.

In embodiments of the tufting machine, the cover plate comprises a plurality of recesses formed therealong; and wherein the yarn feed rolls of each set of yarn feed rolls are received within the recesses formed along the cover plate and each include a series of gear teeth located adjacent one end thereof, wherein the yarn feed rolls of each set of each yarn feed rolls are received within the recesses of the cover plate with the gear teeth of the yarn feed rolls in intermeshing engagement such that the yarn feed rolls are driven together by the driving of at least one yarn feed roll by at least one of the motors.

In embodiments of the tufting machine, each set of yarn feed rolls of each yarn feed device comprises at least three yarn feed rolls; and wherein each yarn feed device further comprises at least one indicator configured to generate an indication of a motor state of each motor.

In embodiments of the tufting machine, the tufting machine can include one or more indicators adapted to provide an indication of a motor state of each motor.

In some embodiments, the at least one indicator can comprise at least one light configured to be illuminated to indicate one or more motor states, and wherein the yarn feed device further includes a cover plate positioned in front of the at least one indicator and comprising a substantially translucent material, such that when illuminated, the at least one light is visible through the cover plate.

According to other aspects, a system is provided, comprising: at least one yarn feed unit having a plurality of yarn feed devices received therein, the yarn feed devices configured for feeding yarns to a plurality of needles of a tufting machine; wherein the yarn feed devices each comprise: at least one motor package comprising two or more motors and a motor controller coupled to each of the motors so as to be substantially integrated therewith; and two or more yarn feed roll assemblies, each yarn feed roll assembly comprising a plurality of yarn feed rolls; wherein the yarn feed rolls are arranged in sets of at least two yarn feed rolls and each comprise a body having a forward portion about which one or more yarns are passed and a rear portion; wherein the motor controller of the at least one motor package is configured to independently control operation of each motor of the motor package to drive rotation of the yarn feed rolls so as to feed selected amounts of yarns to the needles; wherein each motor drives at least one yarn feed roll of a set of yarn feed rolls of a yarn feed roll assembly associated therewith; wherein rotation of the at least one yarn feed roll drives rotation of other yarn feed rolls of the set of yarn feed rolls such that the one more yarns extended about the forward portions of each of the yarn feed rolls are drawn thereabout and fed to the needles of the tufting machine.

In embodiments of the system, each yarn feed roll assembly of each yarn feed device further comprises a roll support structure over the motors of the at least one motor package and within which the sets of yarn feed rolls of the yarn feed roll drive assembly are received; wherein the roll support structure, with the sets of yarn feed rolls received therein, is configured to be removeable.

In embodiments of the system, each yarn feed roll drive assembly comprises two sets of yarn feed roll and a roll support structure positioned in front of the at least one motor package; wherein the yarn feed rolls of each set of yarn feed rolls are received within recesses defined in a front portion of the roll support structure; and wherein each of the sets of yarn feed rolls are removable from engagement with the motors and the roll support structure as a unit.

In embodiments of the system, each of the yarn feed rolls comprises a textured surface along the forward portions thereof and a series of gear teeth located adjacent the rear portion of the body thereof, and wherein the yarn feed rolls each are received within a recess formed within a roll support structure positioned over the motors, with the gear teeth of each yarn feed roll of each set of yarn feed rolls intermeshing engagement such that the yarn feed rolls are rotated together by the driving of the at least one yarn feed roll.

In some embodiments of the system, each yarn feed roll of at least one set of yarn feed rolls comprises a different number of gear teeth so as to cause different ones of the yarn feed rolls of the at least one set of yarn feed rolls to be driven at different rates.

In embodiments of the system, each yarn feed roll assembly comprises at least two sets of yarn feed rolls and a roll support structure mountable over the drive motors; wherein the roll support structure includes a base plate having openings configured to receive a drive shaft of each motor therethrough and a cover plate along which the sets of yarn feed rolls are received.

In embodiments of the system, the cover plate comprises a substantially translucent material; and wherein each yarn feed device further comprises at least one indicator, including at least one light configured to be illuminated to indicate one or more motor states; wherein when illuminated, the at least one light is visible through the cover plate.

In embodiments, the yarn feed system of the present disclosure is adapted to provide for the manufacture of standardized yarn feed attachments or units, each of which can include a plurality of yarn feed devices. In embodiments, such yarn feed attachments or units can be removably installed on a tufting machine without requiring the custom design and installation of such a pattern attachment. In embodiments, the yarn feed devices of such a yarn feed unit further can include motor packages with multiple motors coupled to a shared or integrated motor controller included in the motor package, which motor controller can control each of the motors independently. Additionally, in embodiments, multiple sets of yarn feed roll assemblies can be coupled to the motor packages and can be driven thereby for feeding yarns to each of the needles. The yarn feed devices can thus be provided with a reduced footprint, size, and/or weight, and can be removable in whole or in part, e.g., the motor packages, the yarn feed roll assemblies, or the entire yarn feed devices can be quickly and easily removed and replaced in the yarn feed system. In embodiments, the yarn feed devices, and/or the motor packages further can include mounting alignment features adapted to guide and/or align the motor packages into position within a yarn feed unit of the yarn feed system.

Various additional aspects of tufting machines and systems for production of tufted articles are disclosed herein, including, without limitation, a tufting machine, comprising backing feed rolls configured to feed a backing material through the tufting machine; a plurality of needles carrying a plurality of yarns and driven in a reciprocating motion into and out of the backing material as the backing material is fed through the tufting machine; and a yarn feed system including a plurality of yarn feed devices configured to feed a plurality of yarns to the needles, each of the yarn feed devices comprising a series of yarn feed roll assemblies, each including at least one set of yarn feed rolls about which a selected number of yarns are fed; and at least one motor package including at least two motors and a shared motor controller coupled to each motor; wherein each motor of the at least one motor package is coupled to at least one yarn feed roll of at least one set of yarn feed rolls; and wherein the motor controller of the at least one motor package is configured to control each motor of the at least one motor package independently so as to enable selective control of the feeding of selected yarns by the yarn feed rolls coupled thereto.

In embodiments of the tufting machine, the at least one set of yarn feed rolls comprises three yarn feed rolls.

In embodiments of the tufting machine, the yarn feed rolls each can comprise a body having a series of gear teeth arranged adjacent one end of the body; wherein the yarns being fed by each yarn feed device are extended about the bodies of each of the yarn feed rolls; and wherein the gear teeth of each of the yarn feed rolls are configured to engage with gear teeth of one or more adjacent yarn feed rolls in an intermeshing engagement; such that all of the yarn feed rolls are caused to rotate upon rotation of at least one of the yarn feed rolls by a motor coupled thereto.

In some embodiments, at least one yarn feed roll of each set of yarn feed rolls, can comprise a textured roll surface.

In embodiments of the tufting machine, each yarn feed roll assembly of each yarn feed device further can comprise a housing or roll support structure having openings configured to receive a drive shaft of the motors of the at least one motor package therethrough; and wherein the feed rolls of each yarn feed roll assembly are removably mountable within the roll support structure.

In some embodiments, the roll support structure further can comprise a base plate positioned in front of the motors of the motor package with the drive shaft of each motor extending therethrough; a cover plate received over the base plate and each of the drive shafts of the motors; and at least one indicator located along the cover plate.

In other embodiments, each yarn feed roll assembly can comprise at least two sets of yarn feed rolls; wherein each yarn feed roll of each set of yarn feed rolls is received within a recess formed within the cover plate and includes a series of gear teeth located adjacent one end thereof; and wherein the gear teeth of the yarn feed rolls of each set of each yarn feed rolls are engaged together in intermeshing engagement such that the yarn feed rolls are driven together by the driving of at least one yarn feed roll by at least one of the motors.

In embodiments, each set of yarn feed rolls includes three yarn feed rolls.

In embodiments, the motors and motor controller of each motor package can be arranged in a vertically stacked configuration. In some embodiments, the motors and motor controller of each motor package can be arranged in a side-by-side configuration.

In embodiments of the tufting machine, each yarn feed roll assembly of each yarn feed device can comprise at least two sets of yarn feed rolls and a roll support structure positioned in front of the motors; wherein the roll support structure can include a base plate having openings configured to receive a drive shaft of each motor therethrough; and a cover plate positioned over the base plate.

In some embodiments, each yarn feed roll assembly is configured to be removable from the motors of the at least one motor package as a unit.

In some embodiments, each yarn feed device can further include at least one indicator positioned along the cover plate.

In some embodiments, the at least one indicator can comprise at least one light configured to indicate one or more motor states when illuminated; and wherein the cover plate can comprise a substantially translucent material, such that when illuminated, the at least one light is visible through the cover plate.

In another aspect, a system for feeding yarns to a plurality of needles of a tufting machine comprises at least one yarn feed unit; and a series of yarn feed devices received within the yarn feed unit; wherein the yarn feed devices each comprise a motor package comprising two or more motors and a shared motor controller configured to independently control operation of each motor of the motor package; and two or more yarn feed roll assemblies, each yarn feed assembly comprising at least one set of at least two yarn feed rolls, yarn feed roll each comprising a body having a forward portion about which one or more yarns are passed and a rear portion; wherein each of the motors of each motor package of each yarn feed device drives at least one yarn feed roll of a set of yarn feed rolls of a yarn feed roll assembly associated therewith; and wherein rotation of the at least one yarn feed roll drives rotation of one or more other yarn feed rolls of the at least one set of yarn feed rolls such that the one more yarns extended about the forward portions of each of the yarn feed rolls of the set of yarn feed rolls are drawn thereabout and fed to the needles of the tufting machine.

In embodiments of the system, each yarn feed roll drive assembly can comprise a roll support structure removably mountable over the motors of the at least one motor package, and wherein the one or more sets of yarn feed rolls of each yarn feed roll drive assembly are removably mountable from the roll support structure.

In embodiments of the system, each yarn feed roll drive assembly can comprise at least two sets of yarn feed rolls and a roll support structure positioned in front of the at least one motor package; wherein the yarn feed rolls of each set of yarn feed rolls are received within recesses defined in a front portion of the roll support structure, and wherein the yarn feed rolls are removable with the roll support structure as a unit.

In embodiments of the system, each of the yarn feed rolls can comprise a textured surface along the forward portions thereof and a series of gear teeth at the rear portion of the body thereof. In some embodiments, the yarn feed rolls each are received within a recess formed within a roll support structure, with the gear teeth of each yarn feed roll arranged in intermeshing engagement such that the yarn feed rolls are rotated together by the driving of at least one yarn feed roll one of the motors.

In some embodiments of the system, at least one yarn feed roll of the yarn feed rolls of the at least one of the set of yarn feed rolls comprises a different number of gear teeth so as to cause different ones of the yarn feed rolls to be rotated at different rates.

In embodiments of the system, each yarn feed roll assembly can comprise at least two sets of yarn feed rolls, and a roll support structure mountable over the motors and including a base plate having openings configured to receive a drive shaft of each motor of the at least one motor package therethrough, a cover plate, and at least one indicator visible along the cover plate; wherein each yarn feed roll assembly is removable from the motors of the at least one motor package as a unit.

In some embodiments, the cover plate can comprise a substantially translucent material. In embodiments, the at least one indicator can comprise at least one light that can be illuminated to indicate one or more motor states, wherein the at least one light is visible through the cover plate when illuminated.

In embodiments of the system, the body of each yarn feed roll can comprise a molded or machined structure. In some embodiments can have a textured surface substantially integrally formed therealong. In addition, in embodiments, a series of gear teeth can be formed as a part of the body of each yarn feed roll at a first end thereof so as to define a substantially unitary yarn feed roll.

Various features, objects and advantages of the present disclosure will become apparent to those skilled in the art upon reading the following detailed description when taken in conjunction with the accompanying drawings.

DESCRIPTION OF DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced. Those skilled in the art further will appreciate and understand that, according to common practice, the various features of the drawings discussed below are not necessarily drawn to scale, and that the dimensions of various features and elements of the drawings may be expanded or reduced to more clearly illustrate the embodiments of the present disclosure described herein.

DETAILED DESCRIPTION

Figure 1A:
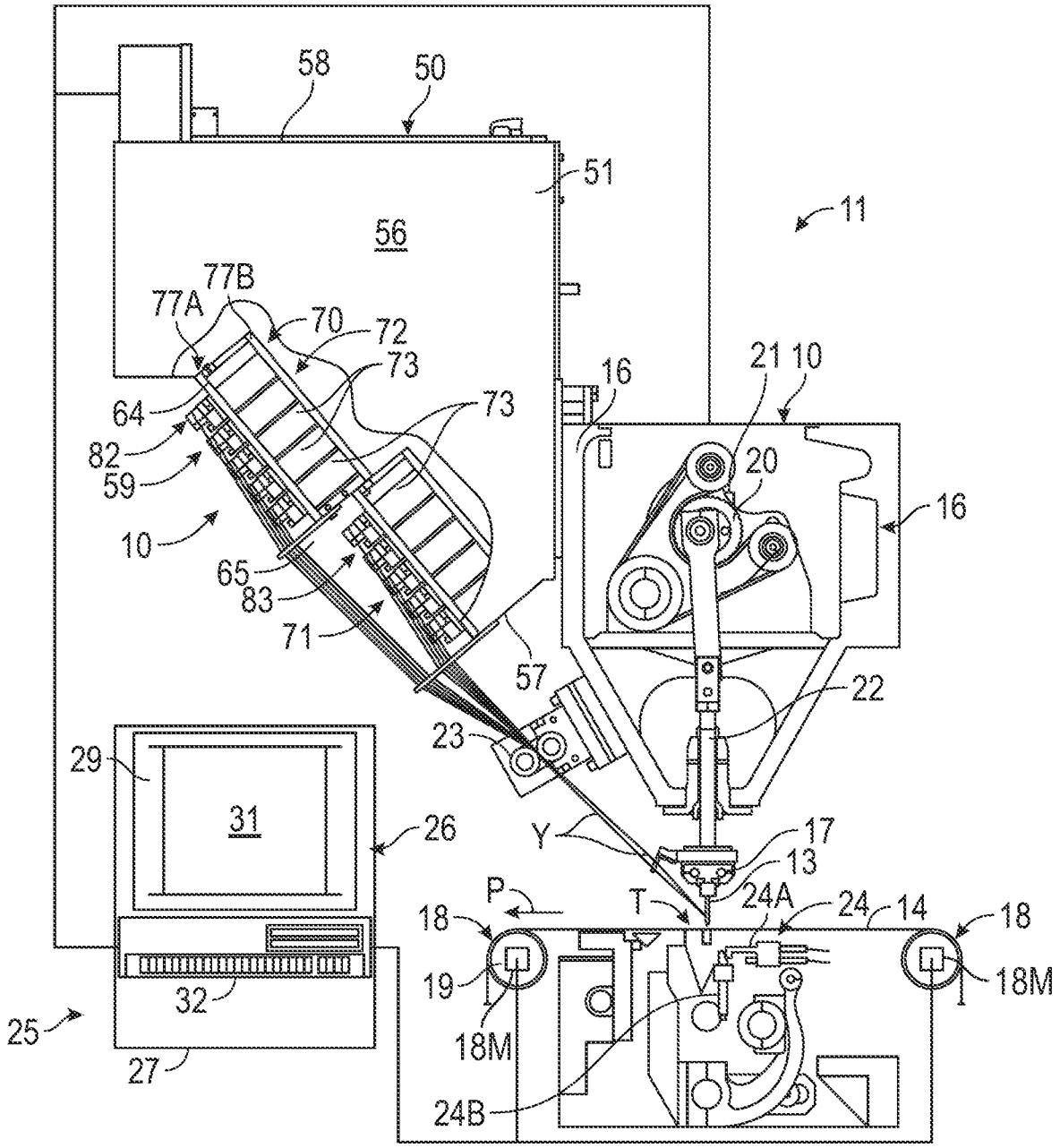
FIGS. 1A-1B are perspective views, with parts broken away, illustrating a tufting machine with a yarn feed system according to principles of the present disclosure.

Referring now in greater detail to the drawings in which like numerals indicate like parts throughout the several views, FIGS. 1A-3B generally illustrate example embodiments of a yarn feed system 10 and components or features thereof, according to principles of the present disclosure.

In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As one of ordinary skill would appreciate, different persons may refer to the same feature or component by different names. This document does not intend to distinguish between components or features that differ in name only. The figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity. In the following description and in the claims, the terms "including" and "comprising" are used in an open-ended fashion, and thus, should be interpreted to mean "including, but not limited to."

As used in this specification and the appended claims, the singular forms "a", "an" and "the" include plural elements of references unless the context clearly dictates otherwise.

Thus, for example, reference to a yarn feed device can include one or more yarn feed devices.

"Coupled" refers to either a direct connection or an indirect connection (e.g., at least one intervening connection) between one or more objects or components. The phrase "directly attached" means a direct connection between objects or components.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

In embodiments, the yarn feed system 10 can comprise a yarn feed pattern attachment configured to be mountable to a tufting machine 11 (FIGS. 1A-1C) for controlling the feeding of yarns Y to the needles 13 of the tufting machine 11. The yarn feed system 10 of the present disclosure further can be configured to enable the feeding of individual yarns to each needle to be independently controlled to enable greater precision and control in the formation of tufts of yarn in a backing material 14 passing through the tufting machine and beneath the needles 13 in order to form programmed or desired carpet patterns, while additionally providing a more compact footprint and/or size, and which, in embodiments, can further enable use of replaceable yarn feed devices, and provide for reductions in weight and a number of electrical connections required for installation of the yarn feed system on the tufting machine.

Figure 1B:
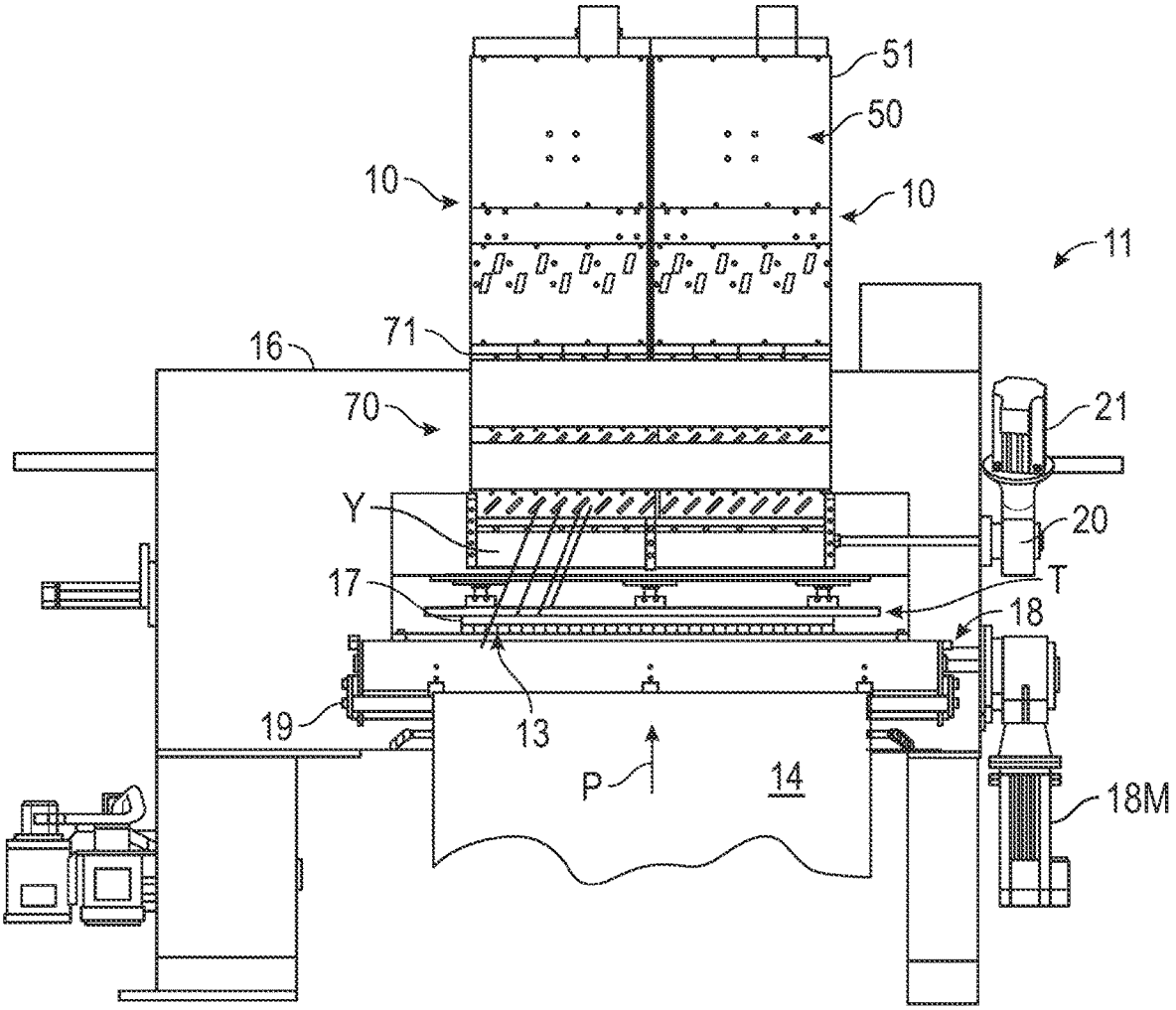

As indicated in FIGS. 1A-1B, the tufting machine 11 generally can include a frame 16, and a machine main drive shaft 20 driven by one or more motors 21. As the main drive shaft is rotated by the motors, a series of push rods 22 are driven in a substantially vertically reciprocating motion, which in turn reciprocally drives at least one needle bar 17 carrying the plurality of needles 13 mounted in spaced series therealong into and out of the backing material 14. The tufting machine further can include a series of backing feed rolls 18, which can include one or more spike rolls 19, driven by motors 18M for feeding the backing material 14 along a path of travel P through a tufting zone T defined beneath the needles of the tufting machine, Puller rolls 23 also can be provided between the yarn feed system and the needles, and generally can be configured to pull the yarns for feeding to the needles 13.

It will be understood that the yarn feed system of the present disclosure can be utilized on any type of tufting machine, including tufting machines having single and dual needle bars 17, which needle bars also can be shifted in a transverse direction across the backing material. In embodiments, the needle bar or needle bars can have various arrangements of needles mounted therealong. For example, the needle bar or needle bars can have in-line or staggered rows of needles.

As the needle bars are reciprocated, the needles 13 are moved vertically between a raised position out of engagement with the backing material 14 passing therebeneath and a lowered, engaging position extending through the backing material. A series of gauge parts 24 (FIG. 1A), which, in various embodiments, can include loopers, hooks, level cut loop loopers or hooks (LCL loopers), cut/loop clips, or other gauge parts, are mounted beneath a bed plate of the tufting machine and are moveable toward and away from the needles. The gauge parts generally will be configured to pick up loops of yarns from the needles for the formation of tufts of yarn within the backing material. For example, in an embodiment as indicated in FIG. 1A, a series LCL loopers 24A with knives 24B are shown, which LLC loopers can be operable to form cut and loop pile tufts, although other types of gauge parts also can be used.

The tufting machine 11 further can be include a control system 25 including a system controller or control unit 26 that in embodiments can include programming configured to monitor and control the various operative elements of the tufting machine, such as the reciprocation of the needle bars, the backing feed, shifting of the needle bars, bedplate position, feeding of the yarns, etc. In embodiments, the system controller 26 generally can be linked to and/or incorporated with the tufting machine. For example, in embodiments, such as shown in FIG. 1A, the system controller 26 can be housed within a cabinet or work station 27 that can be located adjacent the tufting machine frame, and can include a control computer and/or one or more processors, and an operator interface 29 that can include, for example, a monitor 31 an input device 32, such as a keyboard, mouse, keypad, drawing tablet, or similar input device or system as would be recognized by those skilled in the art. In addition, the monitor 31 could be a touch screen type monitor to enable operator input to the system controller.

Still further, it will be understood by those skilled in the art that while the controller has been disclosed in an example embodiment as including a separate work-station, or as being housed a separate cabinet, the system controller further can be otherwise linked to or coupled to the tufting machine. For example, in some embodiments, the system controller could be mounted to the tufting machine frame, and could include a monitor and operator interface configured to enable an operator to monitor and/or control the operation of the tufting machine. It is also may be possible to include the system controller 26 as part of an overall operational control system, with the control functions of the yarn feed system 10 and other operative components of the tufting machine 11 being controlled and operated with a single operator interface; and in some embodiments, the control system can be linked to a remote server.

The system controller 26 generally will be configured to monitor feedback from and control various operative or drive elements of the tufting machine. For example, in embodiments, such as monitoring and receiving feedback from a main shaft sensor (e.g. in embodiments, an encoder) for controlling the one or more a main shaft drive motors so as to control the reciprocation of the needles; monitoring and controlling one or more drive motors for the backing feed rolls 18, for feeding the backing material through the tufting zone; and monitoring and controlling feeding of the yarns to each needle by the yarn feed system 10. In embodiments, one or more sensors also can be mounted to the frame 16 in a position to provide further position feedback regarding the needles. In addition, in some embodiments, for shiftable needle bar tufting machines, the system controller 26 also can monitor and control the operation of one or more needle bar shift mechanism(s) (FIG. 1B) for shifting the needle bar 17 or needle bars according to pattern instructions for a pattern being tufted.

The system controller 26 (FIG. 1A) may receive and store pattern instructions or information for a series of different carpet patterns. Such pattern instructions can be stored as a data file in memory at the system controller itself for recall by an operator, or can be downloaded or otherwise input into the system controller by the means of a floppy disk or other recording medium, direct input by an operator at the system controller, or from a network server via network connection. In addition, in embodiments, the system controller can receive inputs directly from or through a network connection from a design center. Such a design center can include a separate or stand-alone design center or work-station computer with monitor and user input, such as a keyboard, drawing tablet, mouse, etc., through which an operator can design and create various tufted carpet patterns. In embodiments, this design center also can be located with or at adjacent the tufting machine or can be remote from the tufting machine.

A pattern file and/or possibly graphic representations of a desired carpet pattern can be provided to the control system, which pattern file can include instructions and/or calculations of various parameters required for tufting such a carpet pattern at the tufting machine, including calculating yarn feed rates, pile heights, backing feed or stitch rate, and other required parameters for tufting the pattern. In embodiments, these pattern files then can be downloaded or transferred to the system controller, to a USB, disk or similar recording medium, or can be stored in memory either at the design center or on a network server for later transfer and/or downloading to the system controller.

Figure 1C:
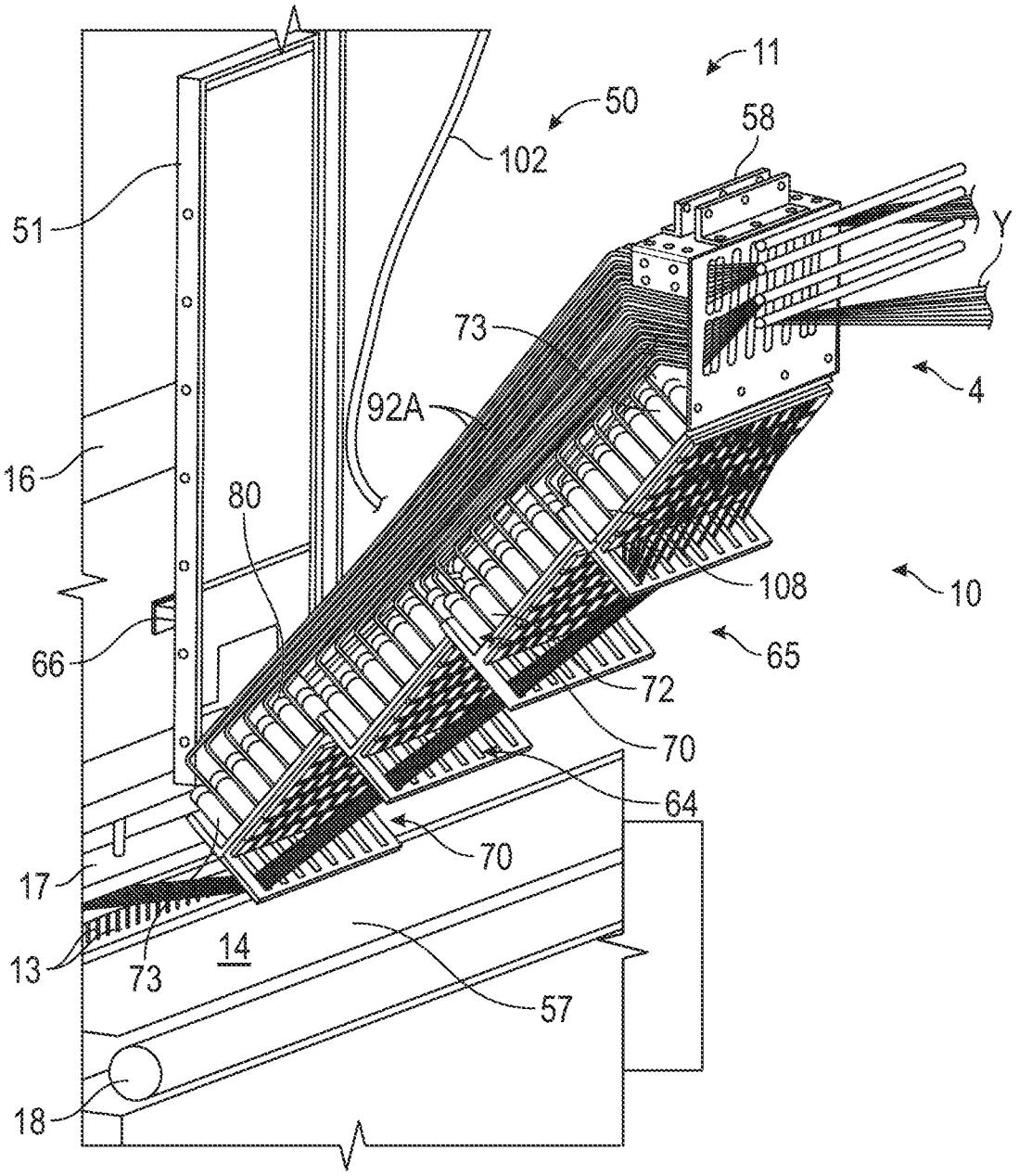
FIG. 1C is a side elevational view, with parts broken away, illustrating the tufting machine of FIGS. 1A-1B with a yarn feed system according to principles of the present disclosure.
Figure 1D:
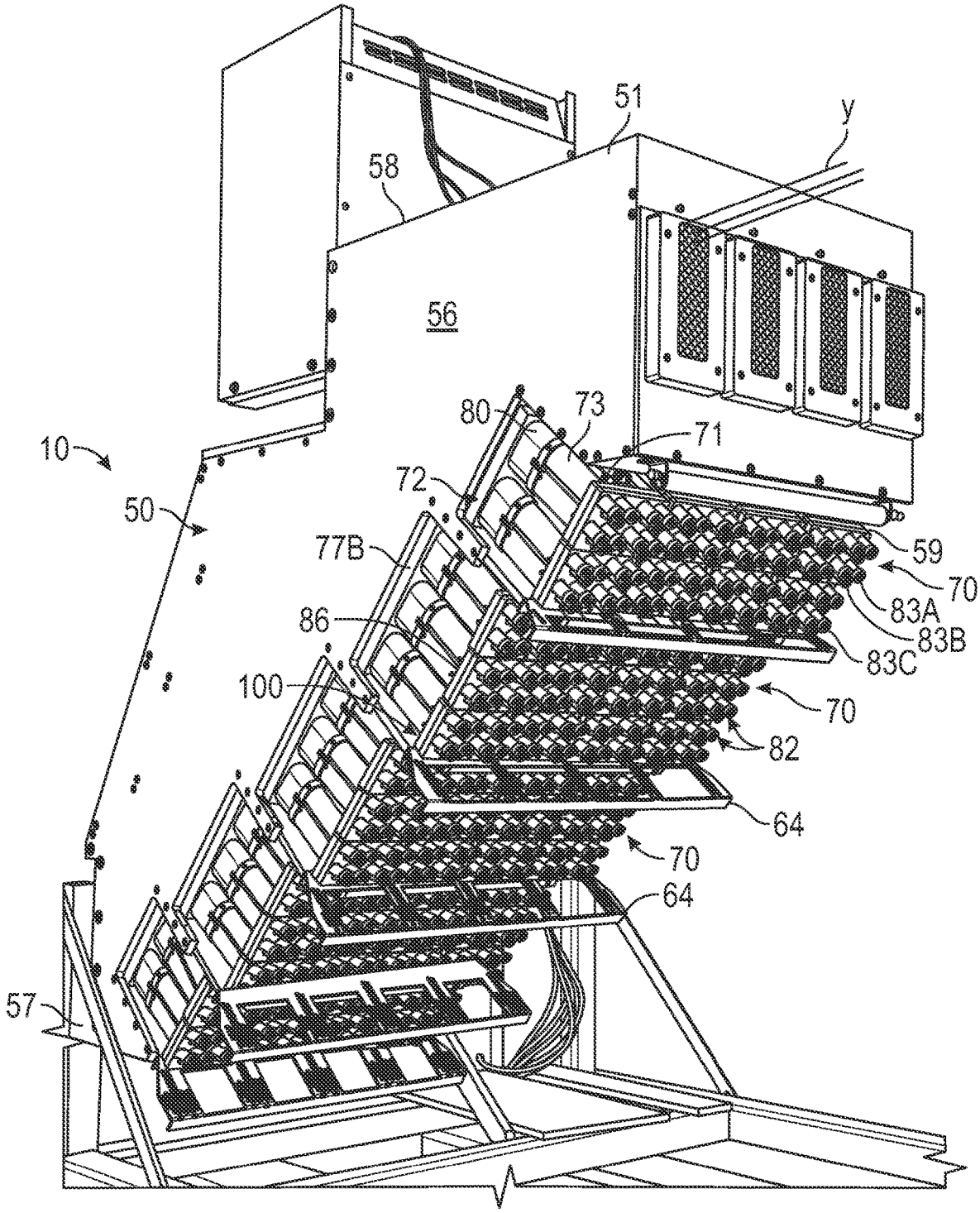
FIG. 1D is a perspective view of a yarn feed system according to the principles of the present disclosure.

As shown in FIGS. 1A-1C, in embodiments, the yarn feed system 10 of the present disclosure can be mounted along the frame of the tufting machine 11, and will be configured to feed yarns Y to each of the needles 13 in accordance with the pattern instructions for a pattern being tufted. In embodiments, such as illustrated in FIG. 1D, the yarn feed system can include at least one yarn feed unit or attachment 50 that can be constructed as a substantially standardized, self-contained unit or attachment capable of being releasably mounted to and removable from the tufting machine frame 16 (FIG. 1A) as a substantially unitary one-piece unit or attachment. The construction of the yarn feed unit 50 can enable the manufacture of substantially standardized yarn-feed units configured to control one or more the feeding of one or more yarns to a predetermined number or set of needles of the tufting machine (e.g., including feeding single and double ends of yarns and, in embodiments more than two yarns. In embodiments, the yarn feed units of the present disclosure further can be mounted to a tufting machine as part of a new machine construction or as a retro-fit or conversion in the field, wherein a series of yarn feed units can be selected and removed from an inventory, depending upon the number of needles of the tufting machine, and mounted in series to the tufting machine. In addition, a series of yarn feed units can be provided, mounted along one or both sides of the frame of the tufting machine.

As shown in FIGS. 1A, 1C and 1D, in embodiments, the yarn feed unit 50 of the present disclosure can include a frame 51, with support plates or beams 52 configured for mounting the yarn feed unit to the frame of the tufting machine such as shown in FIG. 1C; and in some embodiments, also including side plates, and other structural components, so as to define a housing or cabinet 56. As indicated in FIG. 1A, in embodiments, the housing 56 can be configured such that it generally extends upwardly and outwardly from a lower end 57 to an upper end 58 that projects away from the tufting machine frame 16 so as to provide the yarn feed unit with a front face or side 59 that can extend upwardly at an angle with respect to the frame of the tufting machine. The upper end 58 of the housing can be open or can include a cover, and in some embodiments side openings can be formed in the side plates or other components of the housing to promote enhanced and efficient airflow through the yarn feed unit 50 and enable enhanced, rapid dissipation of heat from the operative elements of the yarn feed unit 50 to avoid overheating or damage to the electronic components of the yarn feed unit of the present disclosure. Step plates or brackets 64 also can be mounted at spaced positions along the front face 59 of the yarn feed unit so as to define staggered, stepped or offset sections thereof 65.

As also indicated in FIG. 1B, in embodiments, one or more mounting brackets 66 can be attached to the vertical supports 52 of the frame 51 along the rear side of the housing 56. The mounting brackets can be configured to couple to the frame 16 of the tufting machine 11 with fasteners such as bolts, screws or other removable fasteners, in some embodiments, the mounting brackets and/or supports 52 also can be welded, riveted or otherwise fixed to the tufting machine frame as desired for more permanent mounting of the yarn feed unit to the tufting machine. Multiple mounting brackets further can be used for supporting the yarn feed unit of the present disclosure from a tufting machine, depending upon the size and/or configuration of the yarn feed unit.

As further illustrated in FIGS. 1A and 1C-1D, in embodiments, the yarn feed unit 50 will include a series of yarn feed devices 70 that can be received and removably mounted within the housing 56 of the yarn feed unit. The yarn feed devices can engage and feed individual yarns to associated needles of the tufting machine for individual or single end yarn feed control. It also will be understood that, in some configurations, the yarn feed devices also can be used to feed multiple yarns to selected sets or groups of needles. For example, in a machine with 2,000 needles, each yarn feed device could control feeding of one, two, or more yarns such that 2,000, 1,000, or fewer yarn feed devices may be used to feed the yarns to each of the needles.

In embodiments, each yarn feed unit further can be provided with a number or series of yarn feed devices. For example, each yarn feed unit can be provided with a number of yarn feed devices that can generally correspond to some multiple of the needles of the tufting machine, e.g., in some embodiments, each yarn feed unit can be manufactured with about 100-200 yarn feed devices 70 removably mounted therein (although other configurations having greater or fewer yarn feed devices can also be used). The yarn feed units thus can be manufactured as substantially standardized attachments or units that can be manufactured and stored in inventory for use as needed, without requiring the custom manufacture and assembly of a yarn feed unit of the present disclosure with the construction of the tufting machine. Accordingly, in some embodiments, when the yarn feed system of the present disclosure is required, a series of yarn feed units or attachments according to the present disclosure can be removed from inventory and mounted in series across the width of a tufting machine, with the number of yarn feed units selected dependent upon the number of needles of the tufting machine and the number of yarns being controlled by the yarn feed devices thereof.

Figure 2A:
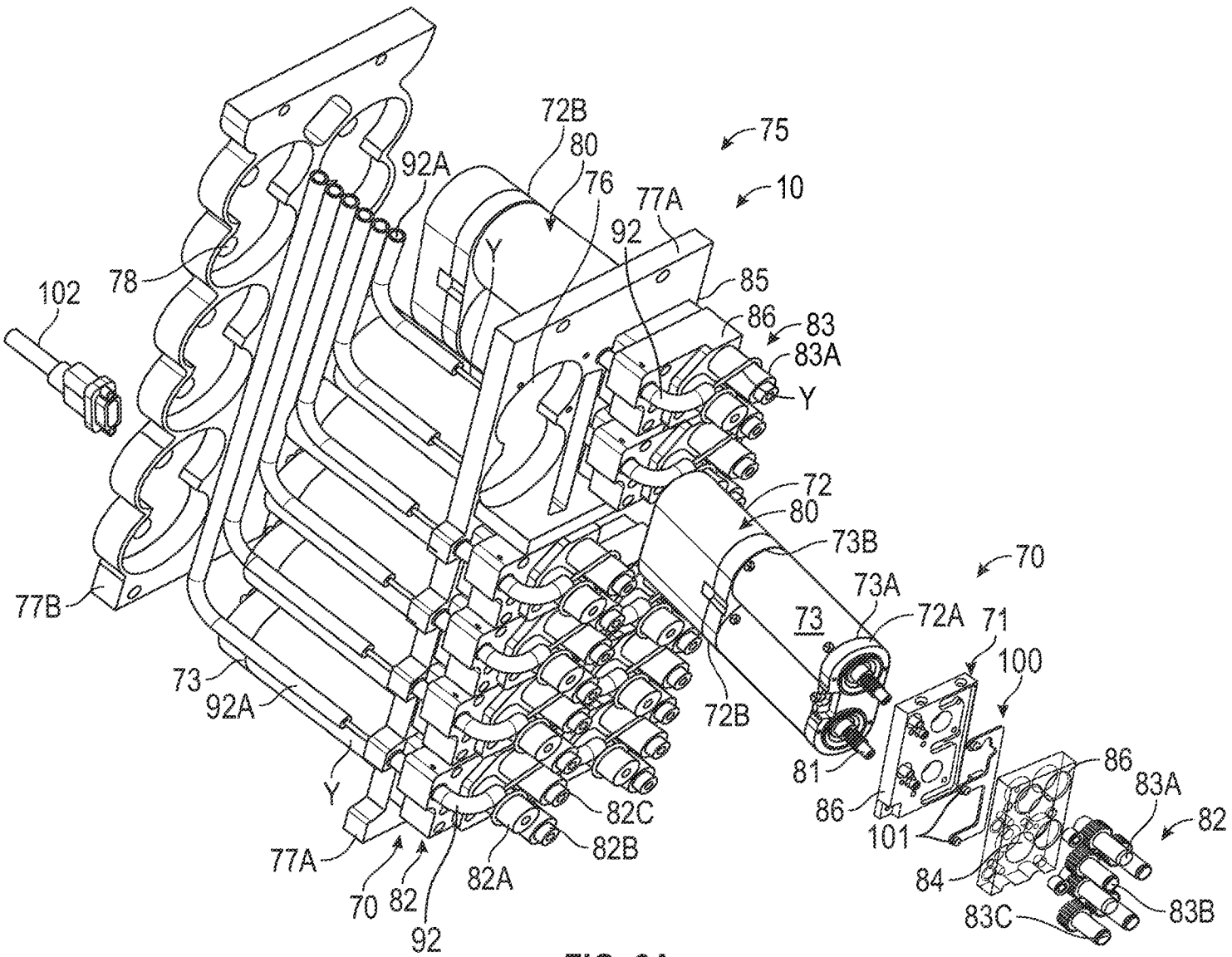
FIGS. 2A-2B are exploded perspective views schematically illustrating series of yarn feed devices received within a portion of the frame of the yarn feed system according to the principles of the present disclosure.
Figure 2B:
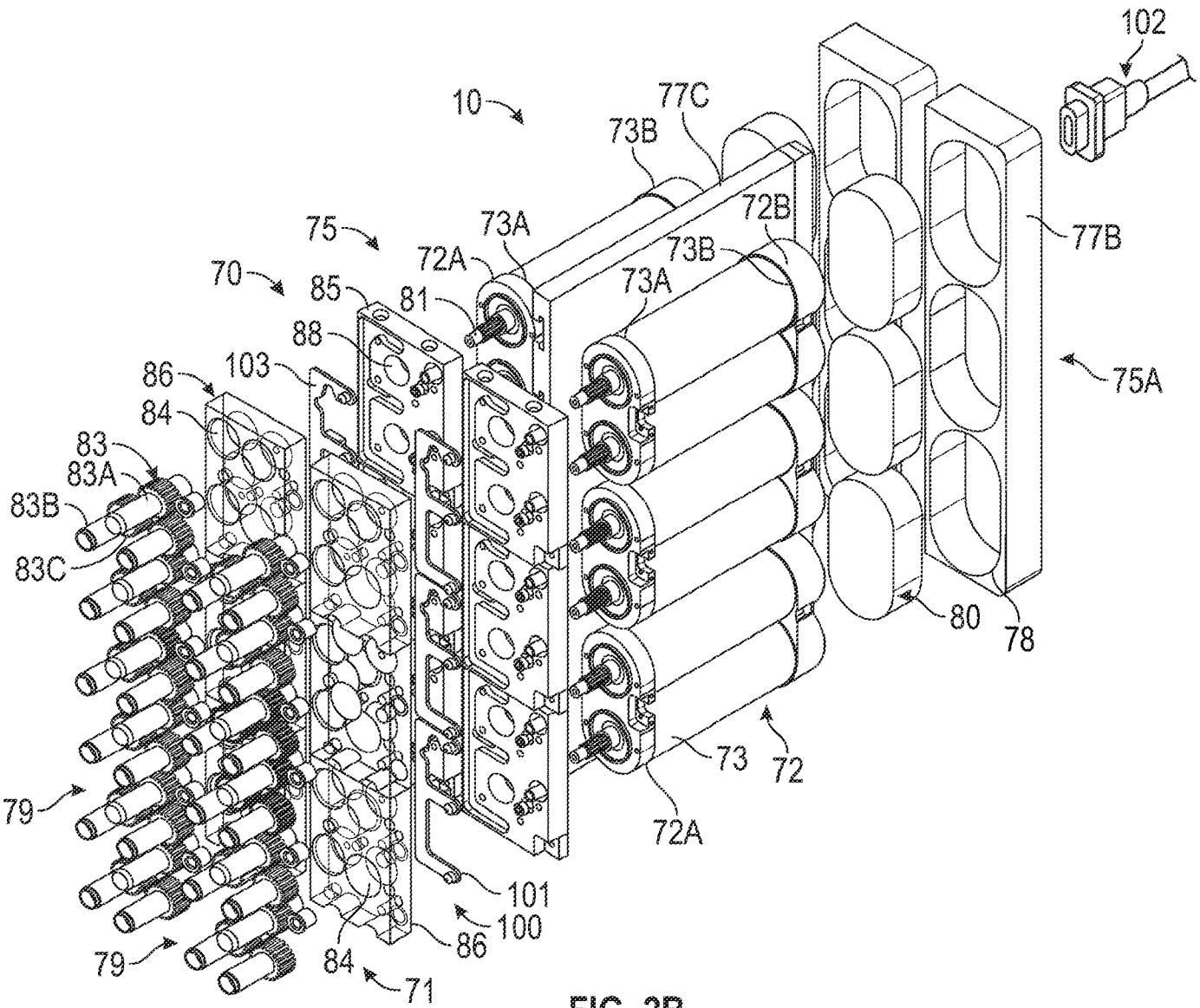

As illustrated in FIGS. 1D, 2A and 2B, in embodiments, each of the yarn feed devices 70 can include a yarn feed roll assembly 71 and an associated or corresponding motor package 72 having two or more motors 73 in accordance with the principles of the present disclosure. In embodiments, each yarn feed roll drive assembly 71 can be include two or more sets 79 of yarn feed rolls 83, and can be otherwise removably mounted in operative engagement with an associated motor package 72 or otherwise integrated therewith as a component or part of each yarn feed device 70.

As further illustrated in FIG. 2A in embodiments, each of the motor packages 72 of the yarn feed devices 70 can be received through an opening 76 of a face plate 77A or other mounting structure mounted to the front of the housing of the yarn feed unit, with the yarn feed roll assemblies associated therewith generally fitting over and/or being attached to the face plate 77A adjacent the opening 76. The yarn feed devices 70 can be removed from the yarn feed units as a unit or integrated component; or, in embodiments, the yarn feed roll assemblies and/or motor packages 72 can be configured to be separately or individually removable from the yarn feed units for easy replacement thereof.

In addition, in some embodiments such as shown in FIG. 2B, sets or groups of multiple yarn feed devices 70 can be arranged together so as to define larger yarn feed modules 75 or packages that can be configured to include multiple yarn feed devices (each including a motor package and associated yarn feed roll assembly or assemblies) mounted within a module frame.

Such modules 75 can be removed/replaced as a multi-set or group of yarn feed devices 70 received within the yarn feed unit. For example, in embodiments, such modules 75 can include 2, 4, 6, or more yarn feed devices 70 mounted in a replaceable module frame 75A that can include a face plate 77A and rear mounting plate 77B; with a series of openings 76 and recesses configured to receive the yarn feed devices therein, and with a wall or partition 77C separating the yarn feed devices 70.

Figure 3A:
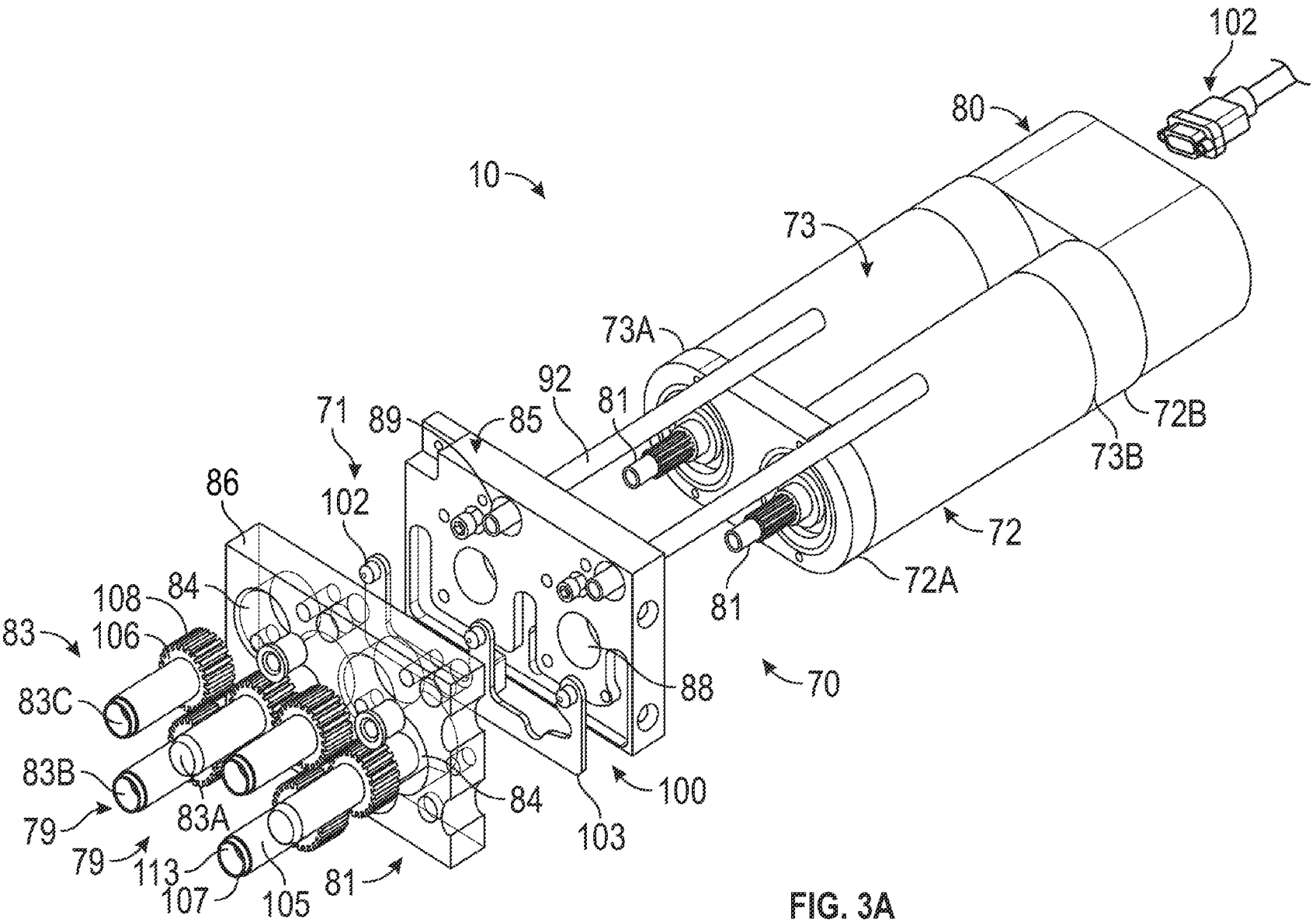
FIG. 3A is a perspective view of an example embodiment of a yarn feed device such as shown in FIGS. 2A-2B.
Figure 3B:
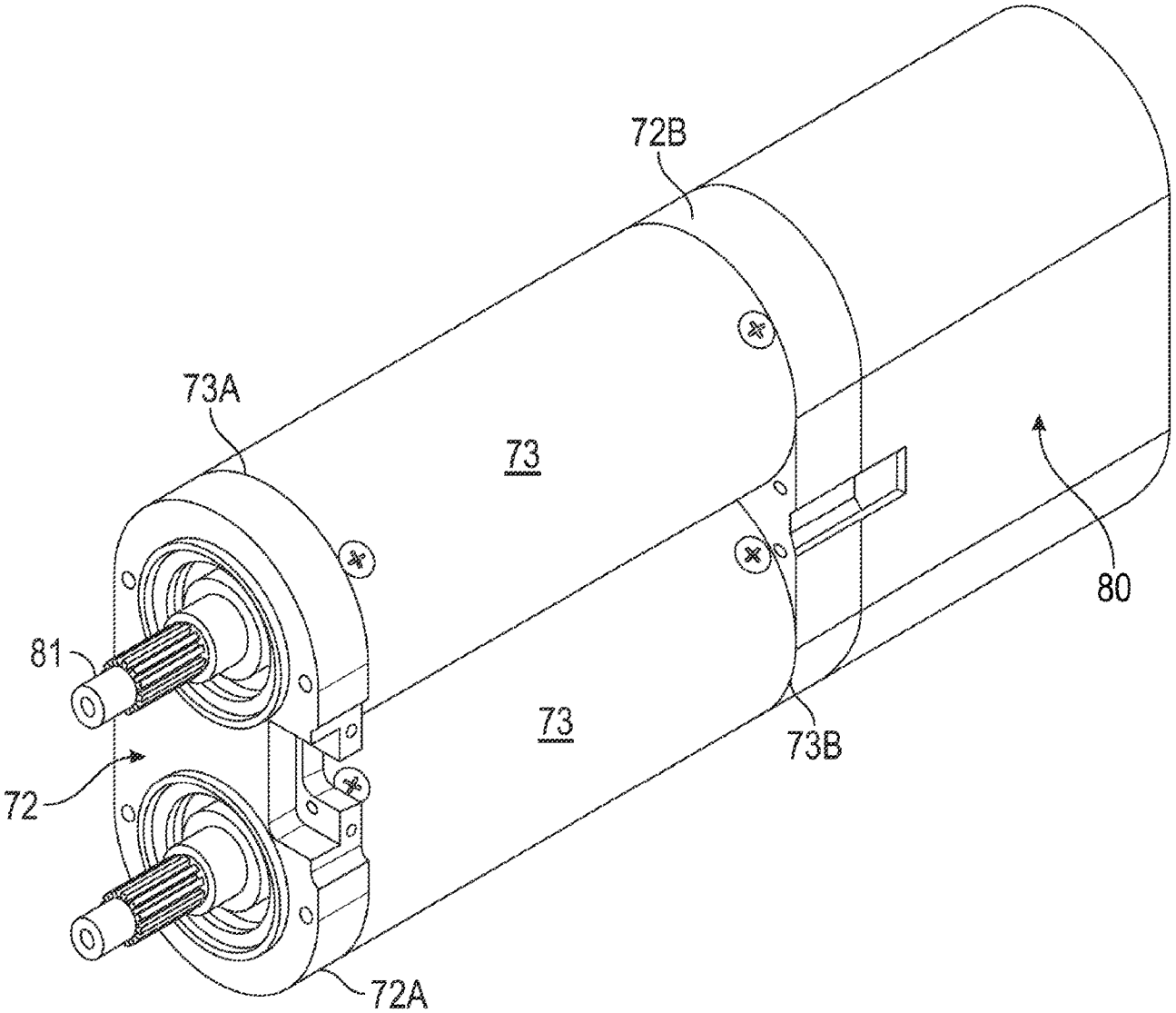
FIG. 3B is a perspective view of an example embodiment of a motor package for use with a yarn feed device of FIGS. 2A-3A.

In embodiments, each motor package 72 can include two or more motors 73, such as indicated in FIGS. 2B-3B. In embodiments, the motors 73 can comprise servo or stepper motors, torque motors, or other variable speed motors. In embodiments, each of the motors 73 can be paired with or coupled to another motor, e.g., each of the motors can be connected together by plates or other couplings, such as a front plate 72A coupling the motors 73 at a proximal or front end 73A thereof (as indicated in FIG. 3B), which front plates 72A generally will be configured to receive the draft shafts 81 of each of the motors 73 therethrough. In some embodiments, the rear or distal ends 73B of the motors can be coupled together by a shared or associated motor controller 80 connected to each of the motors. Each set of motors and their associated motor controller thus can form a substantially unitary motor package 72, including at least two motors and at least one motor controller coupled together to form a unitary structure that can enable replacement of at least two motors and a shared motor controller as a single unit or component part, such as shown in FIGS. 2B-3B. Additional plates, straps, or other attachment members 72B can be provided for coupling the motors together (e.g., at their distal ends 73B along which the motor controller 80 is mounted).

In embodiments, as shown in FIGS. 3A-3B, motor packages can include distal or rear ends that can be received through the openings 76 of the face plate 77A (FIG. 2A) and can be seated within a corresponding recess 78 of rear mounting plate 77B, which can be part of, or can be mountable to the yarn feed unit, so as to locate and substantially fix the motor package in place. As indicated in FIG. 3A, the recesses 78 generally will be configured to receive the integrated motor controller 80 of an associated motor package therein; and, in embodiments, can have an elongated or substantially oval configuration that substantially matches the distal end of the motor controller of a motor package.

In some embodiments, the recesses 78 further can have an open ended construction with a rear side or portion thereof being open, or with an opening formed therethrough. This can enable receipt of a control cable 102 therethrough for connection to the integrated motor controller 80 of an associated motor package; and, in some embodiments, also can help promote air flow around and/or dissipation of heat from the motor packages.

In embodiments, each face plate 77A and mounting plate 77B can be formed from a metal such as aluminum or other lightweight, high strength material. Each of the openings 76 defined in the face plate further can be configured to enable a motor package to be slideably received therethrough. In some embodiments, a series of fasteners, such as bolts, screws, clips, or other similar removable fastening mechanisms, can be extended through the faceplate 77A and can engage corresponding fastener openings or apertures of the front plates 72A of the motor packages 72 for releasably securing the motor packages within the yarn feed unit.

As further illustrated in FIGS. 2A-3A, each motor 73 of each motor package 72 further will include a drive shaft 81 on which one of the yarn feed rolls roll 83A of each associated set 79 of yarn feed rolls 83 is mounted so as to be driven by the operation of the motor. As noted, in embodiments, each of the motors of each motor package will be connected to a single share a motor controller 80 coupled to and integrated with the motors, (e.g., being coupled to the rear ends thereof), with the motor controller 80 being configured to independently control each of its associated motors such that the yarn feed rolls of each set of yarn feed rolls coupled to each of the motors can be separately driven for feeding their yarns to selected ones of the needles independently of the feeding of the yarns by the yarn feed rolls of the other set of yarn feed rolls connected to the other motor of the motor package.

In addition, each of the motor controllers 80 can be linked to the overall control system for the tufting machine, and can be configured to send position information for each of its associated motors to the system controller of 26 (FIG. 1A) of the control system 25, and correspondingly can receive control instructions for the operation of each of the motors linked thereto for controlling the yarns being fed by the yarn feed rolls connected to such motors. For example, in embodiments, encoders or other sensors can be integrated with each motor package to monitor, and can provide information such as positions of the drive shafts 81 of each motor 73. Such information can be sent to the control system that in turn can send control instructions back to the motor controllers to enable control of the yarns fed by each motor.

By linking the two or more motors 73 of each motor package to a single shared or integrated motor controller 80, a cost savings can be provided through sharing of the motor controller between at least two motors. In addition, in embodiments, the number of electrical connections (e.g., cables 102) that may be required to connect the motor controllers to the control system can be further reduced, enabling a more efficient and easier connection the motor controllers to the control system. For example, a single connection and/or cable can be connected to each motor package 72, enabling a reduction of up to ½ or more of such connections.

As additionally indicated in FIGS. 3A and 3B, in embodiments, the motor packages 72 of the yarn feed system 10 further can provide a reduced footprint by the packaging of multiple motors with an associated motor controller together as a substantially integrated single package. For example, in embodiments, each of the motor packages with the pairs of motors and motor controller integrated therewith can have a length of approximately 7 inches to 15 inches (about 175 mm to about 381 mm) or greater, a width or thickness of approximately 1.0-1.15 inches to 2.0-3.0 inches (about 25.4-30 mm to 50 mm 76 mm), and can have a depth or height of approximately 2.75 inches to 5 inches (70 mm to 127 mm), which can provide a reduced dimensional face size. Other motor sizes and configurations also can be provided. In embodiments, the reduction in size of the motor packages can further help reduce weight of each yarn feed device by providing modular yarn feed devices or packages configured with a substantially reduced or smaller size or footprint, which can enable a corresponding reduction in the size, weight and/or complexity of the overall yarn feed units, to facilitate construction, transport and mounting of the yarn feed units on a tufting machine, and connection thereof to the control system.

In addition, as shown in FIG. 2B, the motor controllers 80 can be mounted at a distal end of each motor package and can be received within a corresponding recess 78 defined within the rear mounting plate 77B. As further indicated in FIGS. 2B-3A, the drive shafts 81 for each of the motors of each motor package will project through the face plates of the motor packages at the proximal or front ends thereof. The base and cover plates of a corresponding roll support structure 71 can be positioned over proximal ends of the motor packages, with the drive shafts of each of the motors projecting through at least one opening or passage defined therethrough.

Each of the motors 73 further generally can comprise variable speed electric motors. For Servo motors, Stepper motors or other, similar motors, with a range of speeds of about 1000-5000 rpm or higher, and in embodiments, about 2000-4000 rpm. Each motor further can be of sufficient size and power that is generally sufficient to pull a constant force on a yarn or yarns Y being pulled and fed thereby. For example, in embodiments, the motors can be configured to be able to pull at least approximately 0.75-2.5 Nm peak torque, and in embodiments about 1.0-1.2 Nm peak torque. Preferably, the motors will have a motor power range of about 15 W to 100 W, sufficient to be able to provide yarn feed rates of up to 1500-1800 inches per minute. Other power ranges and yarn feed rates also can be provided.

However, it will be also understood that a variety of different type variable speed electric motors can be used for the motors 73 of the yarn feed units 70 in order to feed a range of yarn sizes (deniers) and materials that would or could be used in the tufting process, which motors are sufficiently compact in size for use in the yarn feed unit of the present disclosure. In embodiments, the motors can have a length of between approximately 5-12 inches (127 mm to 305 mm), and in embodiments, depending on the motors selected and the torque and/or pulling force required; and in some other can range between approximately 3-12 inches or less in length (76 mm to 305 mm); and in embodiments, can have a diameter or face size of approximately 1.0-3.0 inches (25.4 mm to 76 mm), although larger or smaller sized motors can be used, depending upon the application or system requirements. In embodiments, the motors 73 can include an internal encoder or similar feedback device for monitoring the position or speed of the motor. In addition, the motors can be selected for enhanced efficiency of the system for factors such as heat (power) management at the motor drive electronics and power supplies.

In embodiments, as indicated in FIG. 3A, each yarn feed roll assembly 71 can include a housing or roll support structure 82, and a set or series 79 of yarn feed rolls 83. The sets 79 of yarn feed rolls 83 can include 2 or more yarn feed rolls, for example, in some embodiments, the sets of yarn feed rolls can each include 3 yarn feed rolls such as indicated at 83A-83C. Each of the yarn feed rolls of the sets of yarn feed rolls can be received within recesses or cavities 84 defined in a front surface of a cover plate 86 of the roll support structure 82. One or more of the yarn feed rolls 83A-83C of each set 79 of yarn feed rolls 83 (e.g., yarn feed roll 83A) can be operatively connected to and driven by the motors 73 of its associated motor package 72 for feeding one or more yarns to selected needles 13 of the tufting machine as indicated in FIGS. 1A-1B.

In embodiments, such as illustrated in FIGS. 2B-3A, each of the roll support structures 71 can include two or more plates, including a base plate 85 configured to mount to a face plate 77 of the yarn feed unit as indicated in FIG. 2B, with cover plates 86 that can be received and mounted over the base plate. Each of the base plates can be formed from a substantially lightweight rigid material, for example molded or extruded plastic or composite material. Other materials such as aluminum or other lightweight materials or synthetic materials also can be used. Each of the base plates also can include recesses or openings to receive the drive shafts 81 of the motors of an associated motor package therethrough. As additionally illustrated in FIGS. 2B and 3A, in embodiments, the cover plates 86 of each of the roll support structures of each yarn feed device generally can be formed from a lightweight, substantially clear, semi-transparent, or translucent material. For example, in embodiments, the cover plates can be formed from an extruded or molded plastic, composite or synthetic material.

In embodiments, each of the cover plates 86 can have two or more groups of recesses 84, each of which can be configured to receive a corresponding set 79 of yarn feed rolls 83A-83C. In such a configuration, as illustrated in FIG. 3A, two sets of three recesses 84 can be provided in each cover plate, with the recesses configured to receive one of the yarn feed rolls 83A-83C of each set 83 of yarn feed rolls therein. Other configurations of recesses and sets of yarn feed rolls (e.g., 2 recesses and 2 yarn feed rolls, or more) can be used. At least one recess of each group of recesses 84 further can include an opening or passage defined therethrough and which can be configured to receive a drive shaft 81 of one of the motors 73 of an associated motor package 72.

The base and cover plates also can include yarn tube openings 89 configured to receive one or more yarn feed tubes 92 therethrough. The yarn feed tubes can be formed from a plastic or lightweight metal material, or can be formed from various other types of metals or synthetic materials having reduced frictional coefficients so as to reduce the drag exerted on the yarns passing therethrough. The yarn feed tubes can extend rearwardly through the base plate and along the motor package and connect to further yarn tubes 92A (FIG. 1C) for feeding yarns from a supply of yarn such as a creel, etc., and can project through the cover plate, terminating adjacent the yarn feed rolls In embodiments, an indicator 100 further can be provided providing an indication of motor status or state of operation for each of the motors of each motor package. For example, in some embodiments the indicator can include a series of lights 101 arranged between the cover plate and the base plate. For example, in a non-limiting embodiment such as shown in FIG. 3A, a series of 2-3 lights 101 can be arranged along a sheet or circuit board 103 positioned between the cover plate 86 and the base plate 85.

In embodiments, the indicator 100 can comprise a series of LED's, with the LED's being selectively illuminated by the motor controller 80 of the associated motor package 72 so as to generate an indication of operating conditions or a status of the motors of the motor package. When illuminated, the lights can be visible through the substantially clear, semi-transparent or translucent cover plate 86. In some embodiments, the LED's can be illuminated to provide different colors, such as yellow, green, red, or other colors, indicate normal operating conditions and/or fault conditions of the motors. For example, in some embodiments, a green light can be used to indicate the state of one or more of the motors. Alternatively, in embodiments, individual one's of the lights can be selectively illuminated to indicate various conditions relating to the operation of the yarn feed devices, e.g., a defect or stoppage of the operation of one or more motors, yarn breakage or mis-feeds, or other conditions that might require operator attention.

In embodiments, the roll support structure 82 (FIGS. 2A and 3A) and each of the yarn feed rolls 83A-83C of each set 93 of yarn feed rolls of each yarn feed assembly 71 can be formed from a lightweight material. For example, in embodiments, the yarn feed rolls can be formed from an injection molded or extruded composite material, such as a polyvinylchloride (PVC), although other composite, plastic or synthetic materials also can be used, as can various lightweight metal materials, with the selected material(s) having a high strength and rigidity, while being substantially lightweight. In embodiments, one or more of the yarn feed rolls further can include formed with a gripping surface, which can also include the application of a gripping media, such as a rubberized coating, sandpaper, knurling, or similar roughened, tacky surface, or can include gearing that provides enhanced engagement and gripping of the yarn as the drive roll is rotated to avoid slippage of the yarns during feeding.

In some embodiments, the roll support structures and/or the yarn feed rolls can be formed in varying sizes and/or configurations as needed to accommodate the feeding of various numbers and/or sizes of yarns as well as different types of yarns and/or other materials to be fed by the yarn feed rolls. In embodiments, the yarn feed roll assemblies can provide an easily replaceable yarn feed drive system and/or yarn feed device, that can be quickly changed or reconfigured with yarn feed rolls adapted or sized for feeding desired size and/or types of yarns or other materials, and which further can enable the formation of various standard yarn feed roll drive assembly or system designs or configurations. For example, in embodiments, the yarn feed rolls can be removed and replaced with their roll support structures as part of a substantially integrated drive system unit, or simply selected parts thereof, such as the yarn feed rolls, can be replaced as needed.

In the embodiments, such as shown in FIG. 3A, each set 79 of yarn feed rolls 83 can have three yarn feed rolls 83A-83C. Each of the yarn feed rolls can include an elongated body 105 having a first, rear, base or proximal end 106 and a second, forward, distal or feed end 107. Each of the yarn feed rolls further will include a series of gear teeth 108 located adjacent its base end 106. The gear teeth 108 can be formed in or can include various configurations or types of teeth, so as to form various type gears, such as spur, helical, spiral, or other gears. In embodiments, the gear teeth also can be formed integrally with the body of their associated yarn feed roll, or can be formed as a separate gear structure 85 received or formed within a recess 84 of the housing cover plate of each roll support structure, over which the body of the yarn feed roll can be mounted or engaged so that the body of each yarn feed roll is rotated by rotation of its associated gear structure. Such an arrangement can enable removal and replacement of the yarn feed roll bodies as needed, without requiring removal and/or separation of the intermeshing engagement of the gear teeth associated therewith.

As indicated in FIGS. 2B and 3A, when the yarn feed rolls are received within their respective recesses 84 of the cover plate 86 of their roll support structure 71, the gear teeth 108 thereof will be engaged in an intermeshing relationship, with the yarn feed rolls being substantially rigidly mounted within the housing and projecting forwardly therefrom in a spaced arrangement alignment with the forward portions of the yarn feed rolls generally maintained out of contact with each other. A first one of the yarn feed rolls further can include a rearwardly extending drive shaft or socket adapted to receive and engage the driveshaft 81 of an associated motor 71. The drive socket of yarn feed roll 83A can engage the motor driveshaft in a substantially frictional engagement, and, in addition, or alternatively, can be further secured to the driveshaft, for example, in embodiments, by a fastener received through an opening formed in the forward or distal end of the roll body and which engages and secures the yarn feed roll 83A to the motor driveshaft 81.

The additional yarn feed rolls 83B and 83C of each set of yarn feed rolls each generally can be pivotally mounted within their recesses on bushings or shafts 113 received through openings formed therethrough, and will be driven by the engagement of their gear teeth with the gear teeth of the first driven yarn feed roll 83A as it is driven by the motor. The bushings can be coated with or manufactured from polytetrafluoride (e.g., Teflon®), an acetyl resin (e.g., Delrin®) or other, similar reduced friction material, and will support the additional, non-drive or idler yarn feed rolls 83B and 83C while enabling substantially free rotation of the drive rolls 83B and 83C thereabout.

In addition, in embodiments, the mounting arrangement of the yarn feed rolls, with their gear teeth engaged in an intermeshing relationship, can help maintain the yarn feed rolls with their forward ends 107 generally extended in a substantially parallel, spaced relationship. In addition, in embodiments the gear teeth/structures of the yarn feed rolls can be formed at a generally 1:1 ratio, while in other, alternative embodiments, the gear teeth can be formed at other, varying ratios such that one or more of the yarn feed rolls of each set can have different numbers of teeth. Such an arrangement can enable adjustment of roll surface speeds as needed to provide different levels of tension control of the yarns being fed by varying the ratios of the gear teeth, e.g., the first yarn feed roll can be driven at a first speed and the second and third yarn feed rolls driven at second and/or third, different rates.

In some embodiments, as shown in FIGS. 2A and 3A, the forward ends of the yarn feed rolls can be separated and maintained out of contact with each other, and with the yarns being passed and/or wrapped about the multiple yarn feed rolls, (e.g., extending in a generally serpentine path about the forward ends of the yarn feed rolls). Such an arrangement provides for multiple contact/driving points and/or an increased contact area between the yarn feed rolls and yarns without requiring the yarns to be pinched between the rolls. For example, up to approximately 90°-180° or more surface contact area between the yarns and their yarn feed rolls can be provided. This increased surface contact defined between the rolls and the yarns can help provide for enhanced traction or pulling of the yarns entwined thereabout while also helping to substantially reduce the load placed thereon as the yarns are fed about the yarn feed rolls, and can thus provide for enhanced control of the feeding of the yarns. Such an arrangement of the yarn feed rolls also generally does not necessarily require the yarn feed rolls to be in biased or spring bearing contact, such as for driving of each of the yarn feed rolls, as well as for pinching and pulling of the yarns therebetween for feeding to the needles. As a result, wearing of the yarn fed rolls can be reduced by avoiding direct, frictional contact therebetween, and the replacement of the drive rolls further can be facilitated by simple removal of their bearings or support shafts, after which the drive rolls can be quickly and easily changed out.

The arrangement and configuration of the yarn feed rolls of the present yarn feed drive system 10, with the yarn feed rolls being geared together and the yarns entwined or fed thereabout, thus can enable tighter and/or more active, higher control of the feeding of the yarns wrapped and fed thereabout over multiple twist points of the yarns, helping maintain traction and reduce incidence of slipping of the yarns as the yarns are drawn thereabout. The yarn feed rolls also are provided with textured roll surfaces, which, in embodiments, can be applied as a replaceable covering or as a coating, or in other embodiments, can comprise texturing formed along their bodies. The textured surfaces generally will be configured to provide further increased or enhanced traction or grip of the yarns during pulling or feeding of the yarns by the yarn feed rolls.

In embodiments, various textured, tacky or enhanced grip materials also can be used to provide the textured surfaces to the yarn feed rolls. For example, an emery paper or similar abrasive/grit material carrier or sleeve can be applied about the body of each drive roll, and/or, in some embodiments, the drive rolls can be coated with metalized arc spray or thermal spray coating materials that provide a tacky feel or increased grip. Other materials and/or combinations of such textured, tacky or abrasive gripping materials also can be used, including the use of different materials on different ones of the yarn feed drive rolls.

In operation, in embodiments, as indicated in FIGS. 1A-1C, a series of yarns will be fed from a yarn supply, such as a creel, beam, etc., to each of the yarn feed devices of the yarn feed unit or pattern attachment of the tufting machine. In embodiments, each of the yarns can be fed individually, or in sets or groups of yarns, i.e., two yarns, three yarns, etc., through the one or more yarn feed guide tubes mounted to the front surface of the housing of each yarn feed drive system 10, with the yarns being directed along a path of travel into engagement with the yarn feed rolls of each set of yarn feed rolls. The yarns will be wrapped or entwined about the yarn feed rolls and will be drawn through the yarn feed tubes and fed to selected ones of the needles of the tufting machine. The operation of each motor of each yarn feed device further can be controlled by the control system 25, which can provide instructions to the motor controllers of the yarn feed devices to control each motor associated therewith, for feeding varying amounts of yarn as needed to form high or low pile tufts or to pull back certain yarns as needed to form various tufted patterns having a variety of pattern features or looks.

As the yarn feed rolls become worn, or if there is a need to change out the yarn feed rolls to feed different yarns (i.e., yarns of a different size or type), the yarn feed rolls can be quickly and easily disengaged from the motor and the housing, and thereafter replaced with new yarn feed rolls. For example, in one embodiment, the yarn feed rolls can be directly removed from their associated housings and motors, such as with the removal of their fasteners and/or bushings, after which the yarn feed rolls, or possibly the forward body portions thereof, can be replaced with new yarn feed rolls, without necessarily having to remove the housing and/or motor (or the entire yarn feed device, in embodiments) from the yarn feed unit or pattern attachment.

Alternatively, in other embodiments, such as when the entire set of yarn feed rolls needs to be changed out to utilize other, different or varying size yarn feed rolls, the housing and yarn feed rolls can be removed from their associated motor, without having to necessarily remove the motor from the yarn feed attachment or unit housing for replacement of one or more of the yarn feed rolls. It will, however, also be understood that it may be possible to remove and replace the entire yarn feed devices, including the motor packages and the yarn feed roll assemblies thereof, as a unit. Still further, in embodiments, such as where a series of yarn feed devices are provided as a set or module having two of more yarn feed devices mounted together in a removable frame or package, such sets of yarn feed devices can be removed as a unit with the removal of their frame or package.

As indicated in FIGS. 1A and 1D, in embodiments, the yarn feed devices 70 at each of the stepped sections defined therealong the front face 59 of the yarn feed unit 50 generally can be arranged in sections or groups of yarn feed devices in staggered or overlapped series extending upwardly along the front face of the housing as shown in FIGS. 1A and 1D for ease of access for threading into a replacement of the yarn feed devices. This stepped design also enables the tubes to be mounted and extended in overlapping layered arrangements to enable a more compact design for the yarn feed unit. As indicated in FIG. 1C, in embodiments, a series of yarn guides can be mounted between each of these sections, and can include a substantially flat plate attached to and projecting outwardly from the step plates 64 of the yarn feed unit and having a series of openings or slots formed in spaced groups or sets thereacross. In embodiments, the yarns Y can be fed by the yarn feed devices through the openings of the yarn guides to separate and guide the yarns as they are fed into the puller rolls 23 for the tufting machine for feeding to the needles 13. In embodiments, tension bars can be inserted between the yarns Y, which wrap around the tension bars as the yarns are fed from the yarn feed devices so as to help maintain tension and prevent tangling of the yarns as they are fed through the yarn guides.

As additionally shown in FIGS. 2A-3A, each of the motor controllers 80 of each motor package 72 can be integrated with their associated motors. In embodiments, each motor controller can connect to the system controller of the control system via control cable 102, such as a single Controller Area Network (CAN) communication cable that can be received through a recess 78 of the mounting plate 77B and connect to an associated or corresponding motor controller through an opening at the rear of the with all communication between the control system and each of the motor controllers of the yarn feed system generally conducted via a single cable connection. In embodiments, the cable 102 can also be configured to supply power for driving the motors.

In some embodiments, it further can be possible to replace the CAN bus communication system line or cable with other high speed fieldbus communications network connection or bus communication systems, such as an Ethernet, Firewire, USB or other, similar high speed network connection or system. Thus, a single cable can be used to provide instructions from the system controller to the yarn feed controllers of the yarn feed system, and to the motor controllers for control of each motor of their motor package to drive rotation of the yarn feed rolls connected to each motor at different rates (including slowing or potentially stopping rotation of the yarn feed rolls) to feed varying amounts of yarns controlled thereby to the needles associated therewith to form high or low pile tufts or to pull back certain yarns as needed to form various tufted patterns yarn or yarns being fed thereby according to programmed pattern instructions, as well as providing real-time feedback from each motor of the pair or set of the motors of each motor package via their motor controllers.

In embodiments, each motor controller can monitor and communicate real-time feedback information regarding the position of both of its associated motors directly to the control system, which is further receiving feedback regarding other operating systems of the tufting machine, including the position and/or speed of the main shaft, the operation of the backing feed, etc. In response to such feedback information, the system controller of the control system can calculate new motor positions and/or speeds and send updated calculated individual motor position instructions for each motor of the motor package to each of the motor controllers thereof to adjust the operation of each motor individually, e.g., increase or decrease the operating speed thereof, for a desired or prescribed time period of operation of each motor, to accordingly adjust the feed rate of the yarn or yarns being fed by the motors according to the programmed tuft pattern which adjustments can be made substantially in real-time.

The system controller of the control system generally can communicate with each of the yarn feed controllers of the yarn feed devices, with feedback reports being provided from the motor controllers to the system controller. For example, in embodiments, such feedback or other operational information can be provided over a real-time network so as to provide a substantially constant stream of information/feedback regarding the motors. Pattern instructions or motor position information for causing the motor controllers to increase or decrease the rate of operation of the motors and thus change the rate of feed of the yarns as needed to produce the desired pattern step(s) can be provided from the control system.

In addition, in embodiments, the motors can be electronically geared to the main shaft of the tufting machine, e.g., in embodiments, at desired buffered gear ratios that vary depending upon the yarns being fed and the rates of feed of such yarns. The control system can process the feedback information from the tufting machine and from the motor controllers of each motor package, and will issue motor control position instructions or commands to the motor controllers. In response, the motor controllers can control their associated motors for varying the feeding of the individual yarns to each of the respective needles as needed, depending upon the pattern, step, or sequence being run.

The present disclosure accordingly provides a yarn feed roll drive system or assembly that can enable the efficient and easy change out or removal of yarn feed devices, including yarn feed rolls and motors thereof as needed from a pattern attachment or yarn feed unit of a tufting machine. The yarn feed roll drive system further enables the control of individual or single ends of yarns to each of the needles of a tufting machine to enable enhanced control of the feeding of the yarns so as to provide greater precision and to enable a greater varicty and variation in designing and producing carpet patterns.

The yarn feed control system of the present disclosure further enables the manufacture of substantially standardized yarn feed units or attachments that can be constructed with a desired number of yarn feed devices that can be manufactured and tested separately from a tufting machine. In embodiments, such yarn feed units or attachments can be maintained in inventory for mounting on a tufting machine as needed, without requiring a custom manufacture of the yarn feed units. Multiple yarn feed units can be selected from inventory and mounted on a tufting machine and connected to a to the system controller of the control system 25 without requiring extensive cabling to be run and electrical connections made and tested in the field.

Additionally, in embodiments, the yarn feed devices can be constructed as substantially integrated units comprising a motor package of two or more yarn feed motors directly connected/mounted to and linked with one shared or integrated yarn feed controller, and which can be provided in a common housing or package, and with a yarn feed roll assembly having sets of yarn feed rolls being coupled to the motor package to form such substantially integrated yarn feed device.

The construction of the yarn feed units of the present disclosure, including the use of the integrated yarn feed devices, accordingly can help improve reliability and efficiency of manufacture and installation of such units on a tufting machine, further helping to improve the efficiencies in the manufacture and set-up of the tufting machines in the field. The design of the yarn feed control system of the present disclosure further enables relatively quick and efficient expansion and removal and replacement of yarn feed devices or other operative components as needed for ease of manufacturing and maintaining the system.

It will be further understood by those skilled in the art that while the present disclosure has been described above with reference to preferred embodiments, numerous variations, modifications, and additions can be made thereto without departing from the spirit and scope of the present disclosure as set forth in the following claims.

The invention claimed is:

1. A tufting machine, comprising:

at least one needle bar having a plurality of needles mounted therealong;

a yarn feed system including:

a plurality of yarn feed devices configured to feed a plurality of yarns to the needles, each yarn feed device comprising:

at least one motor package comprising at least two motors coupled together in a side-by-side or stacked configuration, and a shared motor controller directly connected to each motor so as to form a substantially integrated component configured to be mountable within and removeable from the yarn feed system as substantially unitary structure; and a set of yarn feed rolls coupled to each motor of the at least one motor package, each set of yarn feed rolls including at least two yarn feed rolls configured to feed one or more yarns to selected needles; and a control system in communication with the shared motor controller of each motor package of the yarn feed system and including programming configured to control feeding of a backing through the tufting machine and to provide instructions to each shared motor controller of each motor package for feeding of each of the plurality of yarns to the needles in to form a selected pattern;

wherein the shared motor controller of each motor package is configured to receive instructions from the control system and independently control each motor of its motor package so as to drive rotation of the yarn feed rolls coupled thereto to selectively feed each of the yarns fed by each yarn feed device to associated needles as needed to form high or low tufts of each yarn or to pull back certain yarns to form the selected pattern.

2. The tufting machine of claim 1, wherein each set of yarn of each yarn feed roll assembly feed rolls comprises three yarn feed rolls.

3. The tufting machine of claim 1, wherein each feed device further comprises a roll support structure positioned in front of the at least one motor package and including a base plate having a series of openings configured to receive a drive shaft of each motor therethrough; and a cover plate received over the base plate and the drive shaft of the motors.

4. The tufting machine of claim 3, wherein the cover plate comprises a plurality of recesses formed therealong; and wherein the yarn feed rolls of each set of yarn feed rolls a series of gear teeth located adjacent one end thereof and are received within the recesses of the cover plate with the gear teeth of the yarn feed rolls in intermeshing engagement such that the yarn feed rolls are rotated together by rotation of at least one yarn feed roll by at least one of the motors.

5. The tufting machine of claim 1, further comprising at least one indicator including at least one light configured to be illuminated to indicate one or more motor states of each motor, and wherein each yarn feed device further includes a cover plate positioned in front of the indicator and formed from a substantially translucent material, such that when illuminated, the at least one light is visible through the cover plate.

6. The tufting machine of claim 1, wherein the yarn feed system comprises a plurality of yarn feed units each having a frame or housing; wherein the frame or housing includes one or more face plates positioned along a front portion of the frame or housing and having a series of openings each configured to receive a motor package defined therethrough.

7. A system, comprising:

at least one yarn feed unit having a plurality of yarn feed devices received therein, the yarn feed devices configured for feeding yarns to a plurality of needles of a tufting machine;

wherein the yarn feed devices each comprise:

at least one motor package comprising two or more motors and a shared motor controller coupled directly to each of the motors so as to be substantially aligned with the motors as part of a substantially integrated component or unit that is configured to be mounted within and removeable from the yarn feed unit as a substantially unitary structure; and at least one yarn feed roll assembly comprising a plurality of yarn feed rolls;

wherein the yarn feed rolls are arranged in sets of at least two yarn feed rolls, and each comprise a body having a forward portion about which one or more yarns are passed and a rear portion;

wherein the shared motor controller of the at least one motor package is configured to receive instructions from a control system of the tufting machine to independently control operation of each motor of the motor package to drive rotation of the yarn feed rolls so as to feed selected amounts of yarns to the needles;

wherein each motor drives at least one yarn feed roll of a set of yarn feed rolls of a yarn feed roll assembly associated therewith;

wherein rotation of the at least one yarn feed roll drives rotation of other yarn feed rolls of the set of yarn feed rolls such that the one more yarns extended about the forward portions of each of the yarn feed rolls are drawn thereabout and fed to the needles of the tufting machine.

8. The system of claim 7, wherein each yarn feed roll assembly of each yarn feed device further comprises a roll support structure removably mountable over the motors of the at least one motor package, and wherein the one or more sets of yarn feed rolls of each yarn feed roll drive assembly are removably mountable from the roll support structure.

9. The system of claim 7, wherein each of the yarn feed rolls comprises a textured surface along the forward portions thereof and a series of gear teeth located adjacent the rear portion, and wherein the yarn feed rolls are received within recesses formed within a roll support structure positioned over the motors, with the gear teeth of each yarn feed roll of each set of yarn feed rolls engaging in intermeshing engagement such that the yarn feed rolls are rotated together by rotation of at least one yarn feed roll at least one of the motors.

10. The system of claim 9, wherein each yarn feed roll of at least one of the sets of yarn feed rolls comprises a different number of gear teeth so as to cause different ones of the yarn feed rolls of the at least one of the set of yarn feed rolls to be driven at different rates.

11. The system of claim 7, wherein each yarn feed device further comprises a cover plate positioned in front of the motors of the at least one motor package, and at least one indicator, the at least one indicator including at least one light configured to be illuminated to indicate one or more motor states; wherein when illuminated, the at least one light is visible through the cover plate.

12. A tufting machine, comprising:

backing feed rolls configured to feed a backing material;

at least one needle bar having a plurality of needles positioned therealong;

a yarn feed system including:

a plurality of yarn feed devices, each of the yarn feed devices configured to feed at least one yarn to a needle of the plurality of needles;

wherein each yarn feed device comprises:

at least one motor package comprising:

at least two motors coupled together in a side-by-side or stacked configuration, and a shared motor controller in communication with each motor;

wherein the shared motor controller is directly attached to each motor so as to define a substantially integrated component that is configured to be removeable from the yarn feed system as a substantially unitary structure; and wherein the shared motor controller of the at least one motor package is configured to independently control each motor;

at least one yarn feed roll assembly positioned in front of the at least one motor package and including at least two sets of yarn feed rolls about which a selected number of yarns are fed, each set of yarn feed rolls comprising a plurality of yarn feed rolls including at least one driven yarn feed roll operatively connected to one of the motors of the at least one motor package so as to be rotated thereby, and at least one additional yarn feed roll driven by the rotation of the at least one driven yarn feed roll; and a system controller for the tufting machine in communication with the shared motor controller of each motor package and configured to provide instructions to the shared motor controller to selectively operate each motor in communication therewith to control of rotation of the yarn feed rolls of the set of yarn feed rolls associated with each motor for feeding varying amounts of yarns for form high or low pile tufts or to pull back certain yarns as needed to form a tufted pattern.

13. The tufting machine of claim 12, wherein the yarn feed system comprises a plurality of yarn feed units each having a frame or housing; wherein the frame or housing includes one or more face plates positioned along a front portion of the frame or housing and having a series of openings each configured to receive a motor package defined therethrough.

14. The tufting machine of claim 12, wherein each yarn feed roll comprises a body having a forward portion, a rear portion, and a series of gear teeth adjacent the rear portion of the body, extended wherein the gear teeth of the at least one driven yarn feed roll and the at least one additional yarn feed roll are arranged in an intermeshing engagement such that rotation of the at least one driven yarn feed roll drives rotation of the at least one additional yarn feed roll.

15. The tufting machine of claim 12, wherein each motor package has a length of approximately 8 inches to 12 inches.

16. The tufting machine of claim 12, wherein the at least one yarn feed roll assembly of each yarn feed device includes further comprises a roll support structure including a base plate mounted in front of the associated motor package and having at least two passages configured to receive a drive shaft of one of the drive motors of an associated motor package defined therethrough, and a cover plate positioned over the base plate; and wherein the sets of cavities are formed in the cover plate, with at least one cavity of each set of cavities having an opening through which the drive shaft of a drive motor is received.

17. The tufting machine of claim 12, wherein each yarn feed device further comprises a cover plate positioned in front of each motor package and at least one indicator that when activated, is visible through the cover plate.

18. A yarn feed system for a tufting machine, comprising:

at least one yarn feed unit having a housing or frame; and a series of yarn feed devices received within the housing or frame and each comprising:

a motor package received within the housing or frame and comprising two or more motors and a shared motor controller substantially aligned with the two or more motors and connected to a rear end of each of the two or more motors to form a substantially unitary component; and one or more yarn feed roll assemblies positioned in front of the integrated motor package and comprising at least one set of yarn feed rolls associated with each motor, each of the yarn feed rolls comprising a body about which one or more yarns are passed;

wherein each of the motors drives at least one yarn feed roll of the set of yarn feed rolls associated therewith, in response to which at least one other yarn feed roll of the set of yarn feed rolls is correspondingly driven such that the one more yarns extended about the yarn feed rolls are fed to the needles of the tufting machine; and wherein each shared motor controller of each motor package is configured to receive instructions from a system controller for the tufting machine and in response, independently operate each motor of its motor package to drive the sets of yarn feed rolls associated therewith for selectively feeding the one or more yarns to each of a plurality of needles.

19. The yarn feed system of claim 18, wherein each set of yarn feed rolls comprises three yarn feed rolls, wherein the yarn feed rolls of each set of yarn feed rolls are received within recesses defined in a front portion of a roll support structure mounted to the housing or frame in front of the motors; and wherein the yarn feed rolls are removable with the roll support structure as a unit.

20. The system of claim 18, wherein each of the yarn feed rolls comprises a textured surface along the forward portions thereof and a series of gear teeth at the rear portion thereof, and wherein each of the yarn feed rolls are received within a recess formed within a roll support structure, with the gear teeth of each yarn feed roll in intermeshing engagement such that the yarn feed rolls are rotated together by the driving the at least one yarn feed roll of each set of yarn feed rolls by the motor associated therewith.

21. The system of claim 18, wherein each yarn feed roll feed rolls comprises a different number of gear teeth so as to cause different ones of the yarn feed rolls to be driven at different rates.

22. The system of claim 18, wherein each yarn feed device comprises an indicator including one or more lights configured to illuminate with different colors to indicate different motor states for each of the motors of the at least one motor package.

23. The system of claim 18, wherein the motors of each motor package are coupled together adjacent a front end thereof by a plate.

* * * * *